US007613607B2

(12) United States Patent
Valve et al.

(10) Patent No.: US 7,613,607 B2
(45) Date of Patent: Nov. 3, 2009

(54) AUDIO ENHANCEMENT IN CODED DOMAIN

(75) Inventors: Päivi Valve, Tampere (FI); Antti Pasanen, Tampere (FI)

(73) Assignee: Nokia Corporation, Espoo (FI)

( * ) Notice: Subject to any disclaimer, the term of this patent is extended or adjusted under 35 U.S.C. 154(b) by 915 days.

(21) Appl. No.: 10/803,103

(22) Filed: Mar. 18, 2004

(65) Prior Publication Data

US 2005/0137864 A1 Jun. 23, 2005

(30) Foreign Application Priority Data

Dec. 18, 2003 (EP) ..... 03029182

(51) Int. Cl.
*G10L 19/14* (2006.01)

(52) U.S. Cl. ..... 704/225; 704/221; 704/223; 704/226

(58) Field of Classification Search ..... 704/225, 704/226, 221, 223
See application file for complete search history.

(56) References Cited

U.S. PATENT DOCUMENTS

| | | | | |
|---|---|---|---|---|
| 2002/0184010 | A1* | 12/2002 | Eriksson et al. | 704/219 |
| 2004/0024594 | A1* | 2/2004 | Lee et al. | 704/219 |
| 2004/0243404 | A1* | 12/2004 | Cezanne et al. | 704/225 |
| 2005/0071154 | A1* | 3/2005 | Etter | 704/223 |

FOREIGN PATENT DOCUMENTS

| | | | |
|---|---|---|---|
| EP | 1081684 | A2 | 3/2001 |
| WO | WO 99/40569 | | 8/1999 |
| WO | WO 01/03317 | A1 | 1/2001 |
| WO | WO 03/098598 | A1 | 11/2003 |

OTHER PUBLICATIONS

Kondoz, A.M., University of Surrey, UK, "Digital Speech Coding for Low Bit Rate Communications Systems", pp. 174-214, 336.
3GPP TS 26.090 V4.0.0, Chapters 5 & 6.1; Figure 2.
3GPP TS 26.092 V4.0.0, Chapters 5 & 6.
3GPP TS 26.093 V4.0.0, Chapter 5.
3GPP TS 26.104 V4.1.0.

* cited by examiner

*Primary Examiner*—Qi Han
(74) *Attorney, Agent, or Firm*—Squire, Sanders & Dempsey, L.L.P.

(57) ABSTRACT

Method and apparatus for enhancing a coded audio signal comprising indices which represent audio signal parameters which comprise at least a first parameter representing a first characteristic of speech are disclosed. A current first parameter value is determined from an index corresponding to at least the first parameter. The current first parameter value is adjusted in order to achieve an enhanced first characteristic, thereby obtaining an enhanced first parameter value. A new index value is determined from a table relating index values to at least first parameter values, such that a new first parameter value corresponding to the new index value substantially matches the enhanced first parameter value.

15 Claims, 15 Drawing Sheets

AUDIO ENHANCEMENT IN CODED DOMAIN

FIELD OF THE INVENTION

The present invention relates to voice enhancement, and in particular to a method and an apparatus for enhancing a coded audio signal.

BACKGROUND OF THE INVENTION

Improved voice quality created by voice processing DSP (Digital Signal Processing) algorithms has been used to differentiate network providers. The transfer to packet networks or networks with extended tandem free operation (TFO) or transcoder free operation (TrFO) will diminish this ability to differentiate networks with traditional voice processing algorithms. Therefore, operators which have generally been responsible for maintaining speech quality for their customers are asking for voice processing algorithms to be carried out also for coded speech.

TFO is a voice standard to be deployed in the GSM (Global System for Mobile communications) and GSM-evolved 3G (Third Generation) networks. It is intended to avoid the traditional double speech encoding/decoding in mobile-to-mobile call configurations. The key inconvenience of a tandem configuration is the speech quality degradation introduced by the double transcoding. According to the ETSI listening tests, this degradation is usually more noticeable when the speech codecs are operating at low rates. Also, higher background noise level increases the degradation.

When the originating and terminating connections are using the same speech codec it is possible to transmit transparently the speech frames received from the originating MS (Mobile Station) to the terminating MS without activating the transcoding functions in the originating and terminating networks.

The key advantages of Tandem Free Operation are improvement in speech quality by avoiding the double transcoding in the network, possible savings on the inter-PLMN (Public Land Mobile Network) transmission links, which are carrying compressed speech compatible with a 16 kbit/s or 8 kbit/s sub-multiplexing scheme, including packet switched transmission, possible savings in processing power in the network equipment since the transcoding functions in the Transcoder Units are bypassed, and possible reduction in the end-to-end transmission delay.

In TFO call configuration a transcoder device is physically present in the signal path, but the transcoding functions are bypassed. The transcoding device may perform control and protocol conversion functions. In Transcoder Free Operation (TrFO), on the other hand, no transcoder device is physically present and hence no control or conversion or other functions associated with it are activated.

The level of speech is an important factor affecting the perceived quality of speech. Typically in the network side there are used automatic level control algorithms, which adjust the speech level to a certain desired target level by increasing the level of faint speech and somewhat decreasing the level of very loud voices.

These methods cannot be utilized as such in future packet networks where the speech travels in the coded format end-to-end from the transmitting device to the receiving device.

Currently the coded speech is decoded in the network and speech enhancement is carried out with linear PCM samples using traditional speech enhancement methods. After that the speech is encoded again, and transmitted to the receiving party.

However, for example, for AMR speech codec the level control is more difficult in the lower modes due to the fact that the fixed codebook gain is no longer scalar quantized but it is vector-quantized together with the adaptive codebook gain.

SUMMARY OF THE INVENTION

It is an object of the invention to provide a method and an apparatus for enhancing a coded audio signal by means of which the above-described problems are overcome and enhancement of a coded audio signal is improved.

According to a first aspect of the invention, this object is achieved by an apparatus and a method of enhancing a coded audio signal comprising indices which represent audio signal parameters which comprise at least a first parameter representing a first characteristic of the audio signal and a second parameter, comprising:

determining a current first parameter value from an index corresponding to a first parameter;

adjusting the current first parameter value in order to achieve an enhanced first characteristic, thereby obtaining an enhanced first parameter value;

determining a current second parameter value from the index further corresponding to a second parameter; and determining a new index value from a table relating index values to first parameter values and relating the index values to second parameter values, such that a new first parameter value corresponding to the new index value and a new second parameter value corresponding to the new index value substantially match the enhanced first parameter value and the current second parameter value.

According to a second aspect of the invention, this object is achieved by an apparatus and a method of enhancing a coded audio signal comprising indices which represent audio signal parameters which comprise at least a first parameter representing a first characteristic of the audio signal and a background noise parameter, comprising:

determining a current first parameter value from an index corresponding to at least a first parameter;

adjusting the current first parameter value in order to achieve an enhanced first characteristic, thereby obtaining an enhanced first parameter value;

determining a new index value from a table relating index values to at least first parameter values, such that a new first parameter value corresponding to the new index value substantially matches the enhanced first parameter value;

detecting a current background noise parameter index value; and determining a new background noise parameter index value corresponding to the enhanced first characteristic. According to a third aspect of the invention, this object is achieved by an apparatus and a method of enhancing a coded audio signal comprising indices which represent audio signal parameters, comprising:

detecting a characteristic of an audio signal;

detecting a current background noise parameter index value; and determining a new background noise parameter index value corresponding to the detected characteristic of the audio signal.

The invention may also be embodied as a computer program product comprising portions for performing steps when the product is run on a computer. The computer program can be directly loadable into an internal memory of the computer.

According to an embodiment of the invention, a coded audio signal comprising speech and/or noise in a coded domain is enhanced by manipulating coded speech and/or noise parameters of an AMR (Adaptive Multi-Rate) speech codec. As a result, adaptive level control, echo control and noise suppression can be achieved in the network even if speech is not transformed into linear PCM samples, as is the case in TFO, TrFO and future packet networks.

More precisely, according to an embodiment of the invention a method for controlling the level of the AMR coded speech for all the AMR codec modes 12.2 kbit/s, 10.2 kbit/s, 7.95 kbit/s, 7.40 kbit/s, 6.70 kbit/s, 5.90 kbit/s, 5.15 kbit/s and 4.75 kbit/s is described. The level of the coded speech is adjusted by changing one of the coded speech parameters, namely the quantization index of the fixed codebook gain factor in the modes 12.2 kbit/s and 7.95 kbit/s. In the rest of the modes the fixed codebook gain is jointly vector-quantized with the adaptive codebook gain, and therefore adjusting the level of the coded speech requires changing both the fixed codebook gain factor and the adaptive codebook gain (joint index).

According to the invention, a new gain index is found such that the error between the desired gain and the realized effective gain becomes minimized. The proposed level control does not cause audible artifacts.

Therefore, according to the invention, level control is enabled also in lower AMR bit rates (not only 12.2 kbit/s and 7.95 kbit/s). The level control in the AMR mode 12.2 kbit/s can be improved by taking into account the required corresponding level control for the comfort noise level.

with male speech samples.

Figure 12:
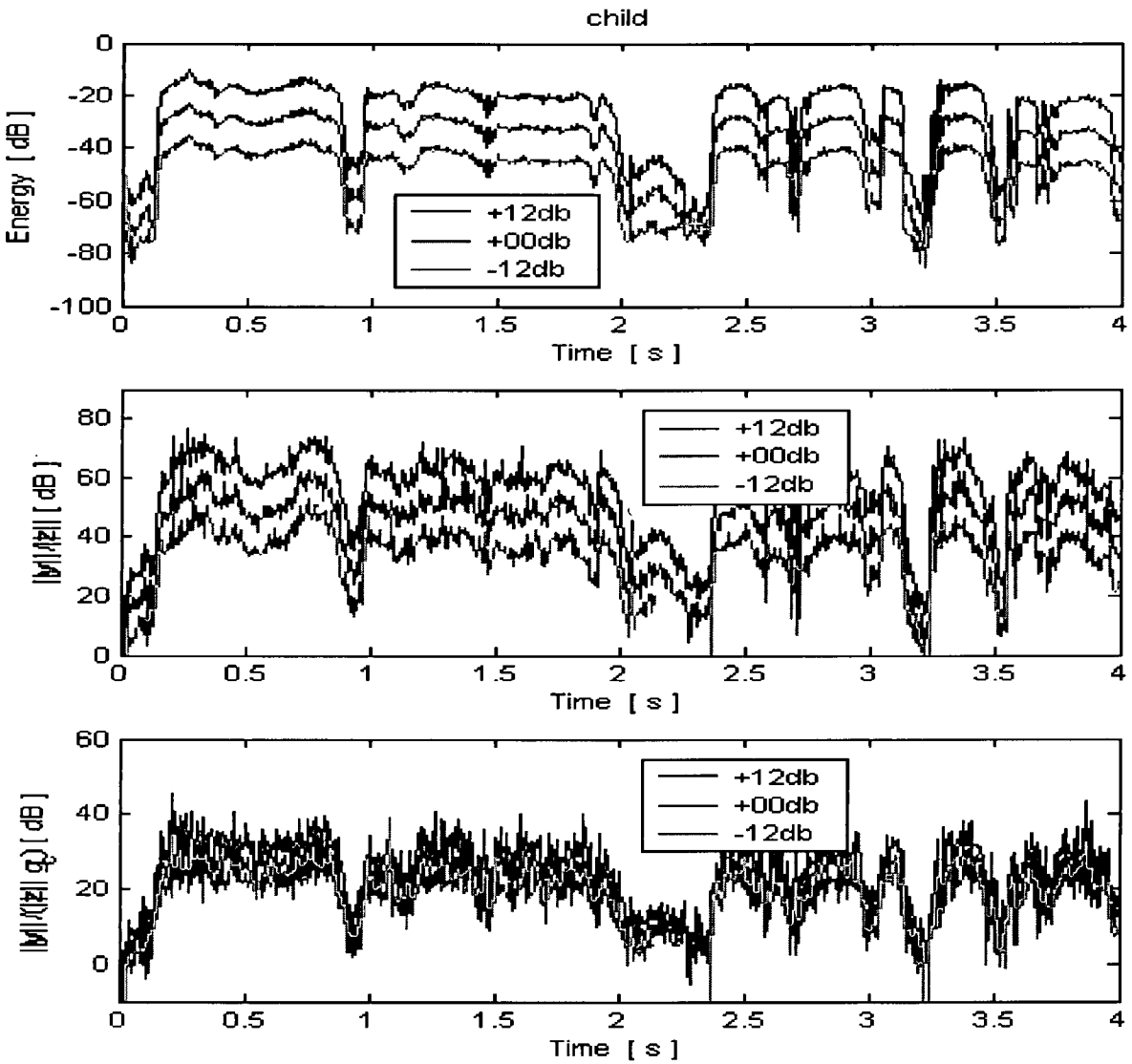

FIG. 12 illustrates values of terms $$\frac{\|y\|}{\|z\|} \text{ and } \frac{\|y\|}{g_c'\|z\|}$$

with child speech samples.

Figure 13:
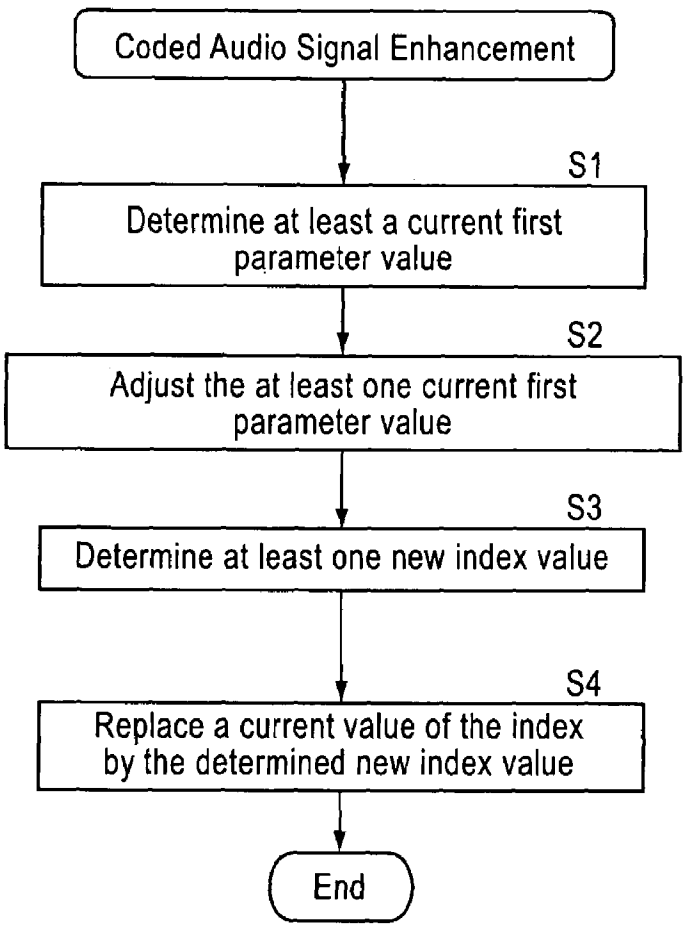

FIG. 13 shows a flow chart illustrating a method of enhancing a coded audio signal according to the invention.

Figure 14:
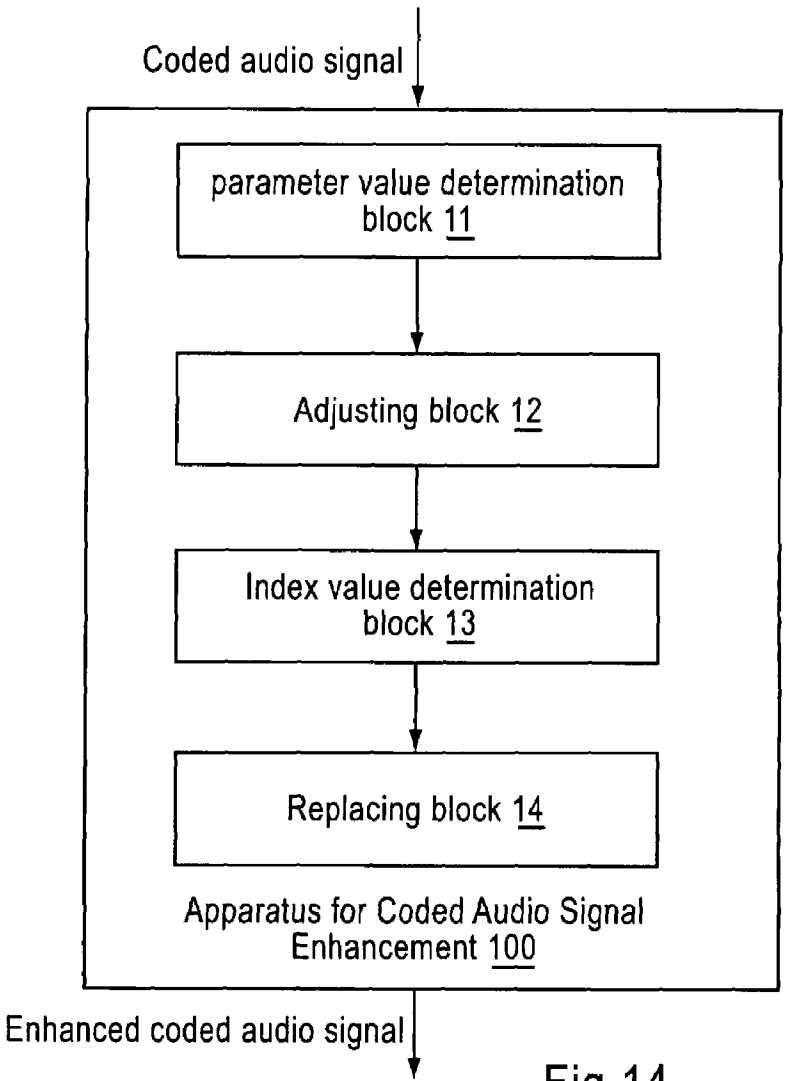

FIG. 14 shows a schematic block diagram illustrating an apparatus for enhancing a coded audio signal according to the present invention.

Figure 15:
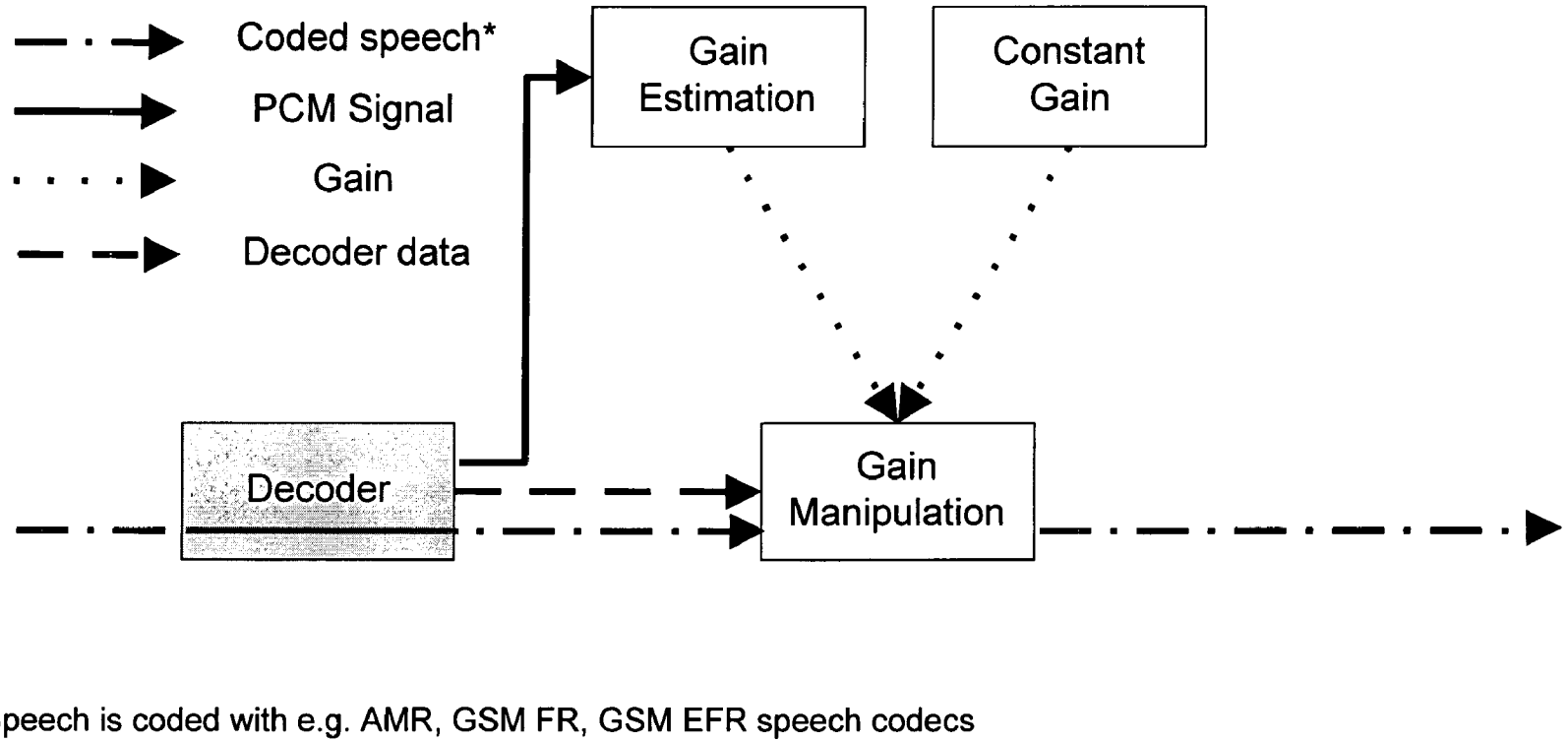

FIG. 15 shows a block diagram illustrating the use of fixed gain.

Figure 16:
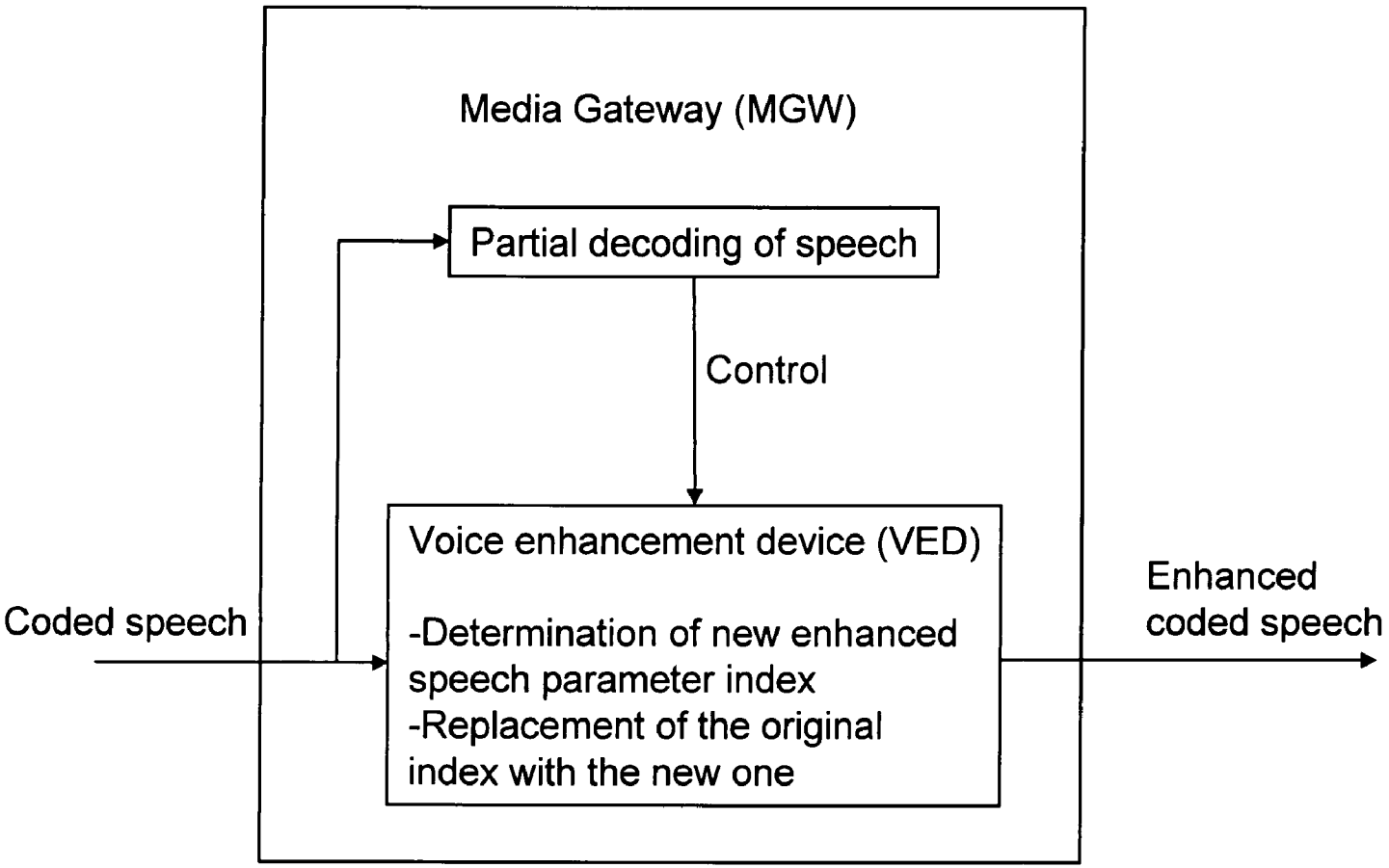

FIG. 16 shows a diagram illustrating a high level implementation of the invention in a media gateway.

DESCRIPTION OF THE PREFERRED EMBODIMENTS

In the following, an embodiment of the present invention will be described in connection with an AMR coded audio signal comprising speech and/or noise. However, the invention is not limited to AMR coding and can be applied to any audio signal coding technique employing indices corresponding to audio signal parameters. For example, such audio signal parameters may control a level of synthesized speech. In other words, the invention can be applied to a audio signal coding technique in which an index indicating a value of an audio signal parameter controlling a first characteristic of the audio signal is transmitted as coded audio signal, in which this index may also indicate a value of an audio signal parameter controlling another audio signal characteristic such as a pitch of the synthesized speech.

The adaptive multi-rate speech codec (AMR) is presented to the extent necessary for illustrating the preferred embodiments. References 3GPP TS 26.090 V4.0.0 (2001-03), "3rd Generation Partnership Project; Technical Specification Group Services and System Aspects; Mandatory Speech Codec speech processing functions; AMR speech codec; Transcoding functions (Release 4)", and Kondoz A. M. University of Surrey, UK, "Digital speech coding for low bit rate communications systems," chapter 6: 'Analysis-by-synthesis coding of speech,' pages 174-214. John Wiley & Sons, Chichester, 1994 contain further information. The adaptive multi-rate (AMR) speech codec is based on the code-excited linear predictive (CELP) coding model. It consists of eight source codecs, or modes of operation, with bit-rates of 12.2, 10.2, 7.95, 7.40, 6.70, 5.90, 5.15 and 4.75 kbit/s. The basic encoding and decoding principles of the AMR codec are explained briefly below. In addition, the matters relevant to the parameter domain gain control are discussed in more detail.

The AMR encoding process comprises three main steps:

LPC (Linear predictive coding) analysis:

The short-term correlations between speech samples (formants) are modeled and removed by a $10^{th}$ order filter. In AMR codec the LP coefficients are calculated using the autocorrelation method. The LP coefficients are further transformed to Line Spectral Pairs (LSPs) for quantization and interpolation purposes utilizing the property of LSPs having a strong correlation between adjacent subframes.

Figure 1:
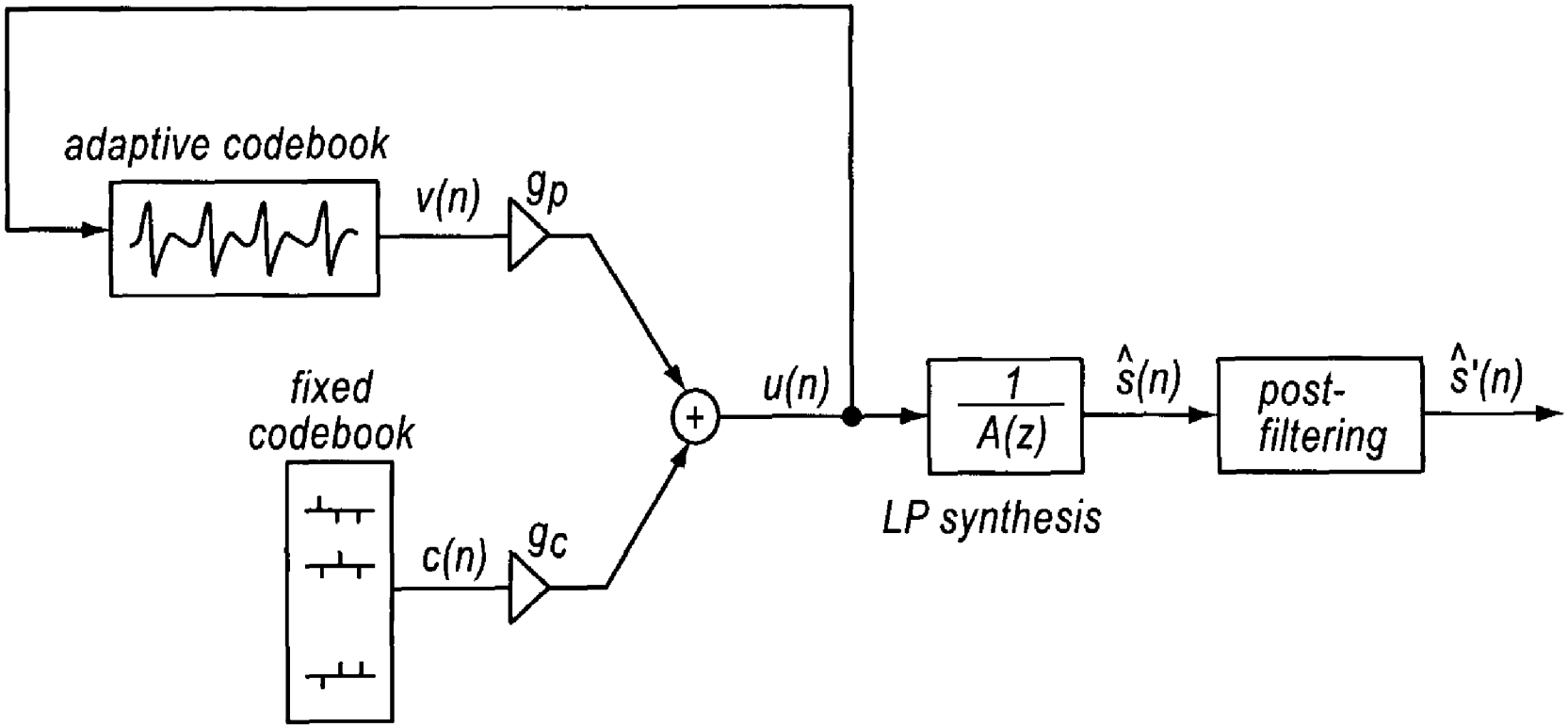
Fig.1 PRIOR ART
FIG. 1 shows a simplified model of speech synthesis in AMR.

Pitch analysis (long-term prediction):

The long-term correlations between speech samples (voice periodicity) are modeled and removed by a pitch filter. The pitch lag is estimated from the perceptually weighted input speech signal by first using the computationally less expensive open-loop method. A more accurate pitch lag and pitch gain $g_p$ is then estimated by a closed-loop analysis around the open-loop pitch lag estimate, allowing also fractional pitch lags. The pitch synthesis filter in AMR is implemented as shown in FIG. 1 using an adaptive codebook approach. That is, the adaptive codebook vector v(n) is computed by interpolating the past excitation signal u(n) at the given integer delay k and phase (fraction) t:

$$v(n) = \sum_{i=0}^{9} u(n-k-i)b_{60}(t+i\cdot 6) + \sum_{i=0}^{9} u(n-k+1+i)b_{60}(6-t+i\cdot 6), \quad (1.1)$$

$$n = 0, \ldots, 39, \quad t = 0, \ldots 5, \quad k = [18,143]$$

where $b_{60}$ is an interpolation filter based on a Hamming windowed sin(x)/x function.

Optimum excitation determination (innovative excitation search):

As shown in FIG. 1, the speech is synthesized in the decoder by adding appropriately scaled adaptive and fixed codebook vectors together and feeding it through the short-term synthesis filter. Once the parameters of the LP synthesis filter and pitch synthesis filter are found, the optimum excitation sequence in a codebook is chosen at the encoder side using an analysis-by-synthesis search procedure in which the error between the original and the synthesized speech is minimized according to a perceptually weighted distortion measure. The innovative excitation sequences consist of 10 to 2 (depending on the mode) nonzero pulses of amplitude ±1. The search procedure determines the locations of these pulses in the 40-sample subframe, as well as the appropriate fixed codebook gain $g_c$.

The CELP model parameters LP filter coefficients, pitch parameters, i.e. the delay and the gain of the pitch filter, and fixed codebook vector and fixed codebook gainare encoded for transmission to LSP indices, adaptive codebook index (pitch index) and adaptive codebook (pitch) gain index, and fixed codebook indices and fixed codebook gain factor index, respectively.

Next, quantization of the fixed codebook gain is explained.

To make it efficient, the fixed codebook gain quantization is performed using moving-average (MA) prediction with fixed coefficients. The MA prediction is performed on the innovation energy as follows. Let E(n) be the mean-removed innovation energy (in dB) at subframe n, and given by:

$$E(n) = 10\log\left(\frac{1}{N} g_c^2 \sum_{i=0}^{N-1} c^2(i)\right) - \overline{E}, \quad (1.2)$$

where N=40 is the subframe size, c(i) is the fixed codebook excitation, and $\overline{E}$ (in dB) is the mean of the innovation energy (a mode-dependent constant). The predicted energy is given by:

$$\tilde{E}(n) = \sum_{i=1}^{4} b_i \hat{R}(n-i), \quad (1.3)$$

where $[b_1\ b_2\ b_3\ b_4]=[0.68\ 0.58\ 0.34\ 0.19]$ are the MA prediction coefficients, and $\hat{R}(k)$ is the quantified prediction error at subframe k:

$$\hat{R}(k)=E(k)-\tilde{E}(k). \quad (1.4)$$

Now, a predicted fixed codebook gain is computed using the predicted energy as in Eq. (1.2) (by substituting E(n) by $\tilde{E}(n)$ and $g_c$ by $g_c'$). First, the mean innovation energy is found by:

$$E_I = 10\log\left(\frac{1}{N}\sum_{j=0}^{N-1} c^2(j)\right) \quad (1.5)$$

and then the predicted gain $g_c'$ is found by:

$$g_c'=10^{0.05(E(n)+\overline{E}-E_I)}. \quad (1.6)$$

A correction factor between the gain $g_c$ and the estimated one $g_c'$ is given by:

$$\gamma_{gc}=g_c/g_{c'}. \quad (1.7)$$

The prediction error and the correction factor are related as:

$$R(n)=E(n)-\tilde{E}(n)=20\log(\gamma_{gc}). \quad (1.8)$$

At the decoder, the transmitted speech parameters are decoded and speech is synthesized.

Decoding of the fixed codebook gain

In case of scalar quantization (in modes 12.2 kbit/s and 7.95 kbit/s), the decoder receives an index to a quantization table that gives the quantified fixed codebook gain correction factor $\hat{\gamma}_{gc}$.

In case of vector quantization (in all the other modes) the index gives both the quantified adaptive codebook gain $\hat{g}_p$ and the fixed codebook gain correction factor $\hat{\gamma}_{gc}$.

The fixed codebook gain correction factor gives the fixed codebook gain the same way as described above. First, the predicted energy is found by:

$$\tilde{E}(n) = \sum_{i=1}^{4} b_i \hat{R}(n-i) \quad (1.9)$$

and then the mean innovation energy is found by:

$$E_I = 10\log\left(\frac{1}{N}\sum_{j=0}^{N-1} c^2(j)\right). \quad (1.10)$$

The predicted gain is found by:

$$g_{c'}=10^{0.05(E(n)+\overline{E}-E_I)}. \quad (1.11)$$

And finally, the quantified fixed codebook gain is achieved by:

$$\hat{g}_c=\hat{\gamma}_{gc}g_c'. \quad (1.12)$$

There are some differences between the AMR modes that are relevant to the parameter domain gain control, as listed below.

In the 12.2 kbit/s mode, the fixed codebook gain correction factor $\gamma_{gc}$ is scalar quantized with 5 bits (32 quantization levels). The correction factor $\gamma_{gc}$ is computed using a mean energy value $\bar{E}$=36 dB.

In the 10.2 kbit/s mode, the fixed codebook gain correction factor $\gamma_{gc}$ and the adaptive codebook gain $g_p$ are jointly vector quantized with 7 bits. The correction factor $\gamma_{gc}$ is computed using a mean energy value $\bar{E}$=33 dB. Moreover, this mode includes smoothing of the fixed codebook gain. The fixed codebook gain used for synthesis in the decoder is replaced by a smoothed value of the fixed codebook gains of the previous 5 subframes. The smoothing is based on a measure of the stationarity of the short-term spectrum in the LSP (Line Spectral Pair) domain. The smoothing is performed to avoid unnatural fluctuations in the energy contour.

In the 7.95 kbit/s mode, the fixed codebook gain correction factor $\gamma_{gc}$ is scalar quantized with 5 bits, as in the mode 12.2 kbit/s. The correction factor $\gamma_{gc}$ is computed using a mean energy value $\bar{E}$=36 dB. This mode includes anti-sparseness processing. An adaptive anti-sparseness post-processing procedure is applied to the fixed codebook vector c(n) in order to reduce perceptual artifacts arising from the sparseness of the algebraic fixed codebook vectors with only a few non-zero samples per an impulse response. The anti-sparseness processing consists of circular convolution of the fixed codebook vector with one of three pre-stored impulse responses. The selection of the impulse response is performed adaptively from the adaptive and fixed codebook gains.

In the 7.40 kbit/s mode, the fixed codebook gain correction factor $\gamma_{gc}$ and the adaptive codebook gain $g_p$ are jointly vector quantized with 7 bits, as in the mode 10.2 kbit/s. The correction factor $\gamma_{gc}$ is computed using a mean energy value $\bar{E}$=30 dB.

In the 6.70 kbit/s mode, the fixed codebook gain correction factor $\gamma_{gc}$ and the adaptive codebook gain $g_p$ are jointly vector quantized with 7 bits, as in the mode 10.2 kbit/s. The correction factor $\gamma_{gc}$ is computed using a mean energy value $\bar{E}$=28.75 dB. This mode includes smoothing of the fixed codebook gain, and anti-sparseness processing.

In the 5.90 and 5.15 kbit/s modes, the fixed codebook gain correction factor $\gamma_{gc}$ and the adaptive codebook gain $g_p$ are jointly vector quantized with 6 bits. The correction factor $\gamma_{gc.}$ is computed using a mean energy value $\bar{E}$=33 dB. The modes include smoothing of the fixed codebook gain and anti-sparseness processing.

In the 4.75 kbit/s mode, the fixed codebook gain correction factor $\gamma_{gc}$ and the adaptive codebook gain $g_p$ are jointly vector quantized only every 10 ms by a unique method as described in 3GPP TS 26.090 V4.0.0 (2001-03), "3rd Generation Partnership Project; Technical Specification Group Services and System Aspects; Mandatory Speech Codec speech processing functions; AMR speech codec; Transcoding functions (Release 4)". This mode includes smoothing of the fixed codebook gain and anti-sparseness processing.

Discontinuous Transmission (DTX)

During discontinuous transmission (DTX) only the average background noise information is transmitted at regular intervals to the decoder when speech is not present as described in 3GPP TS 26.092 V4.0.0 (2001-03), "3rd Generation Partnership Project; Technical Specification Group Services and System Aspects; Mandatory Speech Codec speech processing functions; AMR speech codec; Comfort noise aspects (Release 4)". At the far-end the decoder reconstructs the background noise according to the transmitted noise parameters avoiding thus extremely annoying discontinuities in the background noise in the synthesized speech.

The comfort noise parameters, information on the level and the spectrum of the background noise are encoded into a special frame called a Silence Descriptor (SID) frame for transmission to the receive side.

Figure 2:
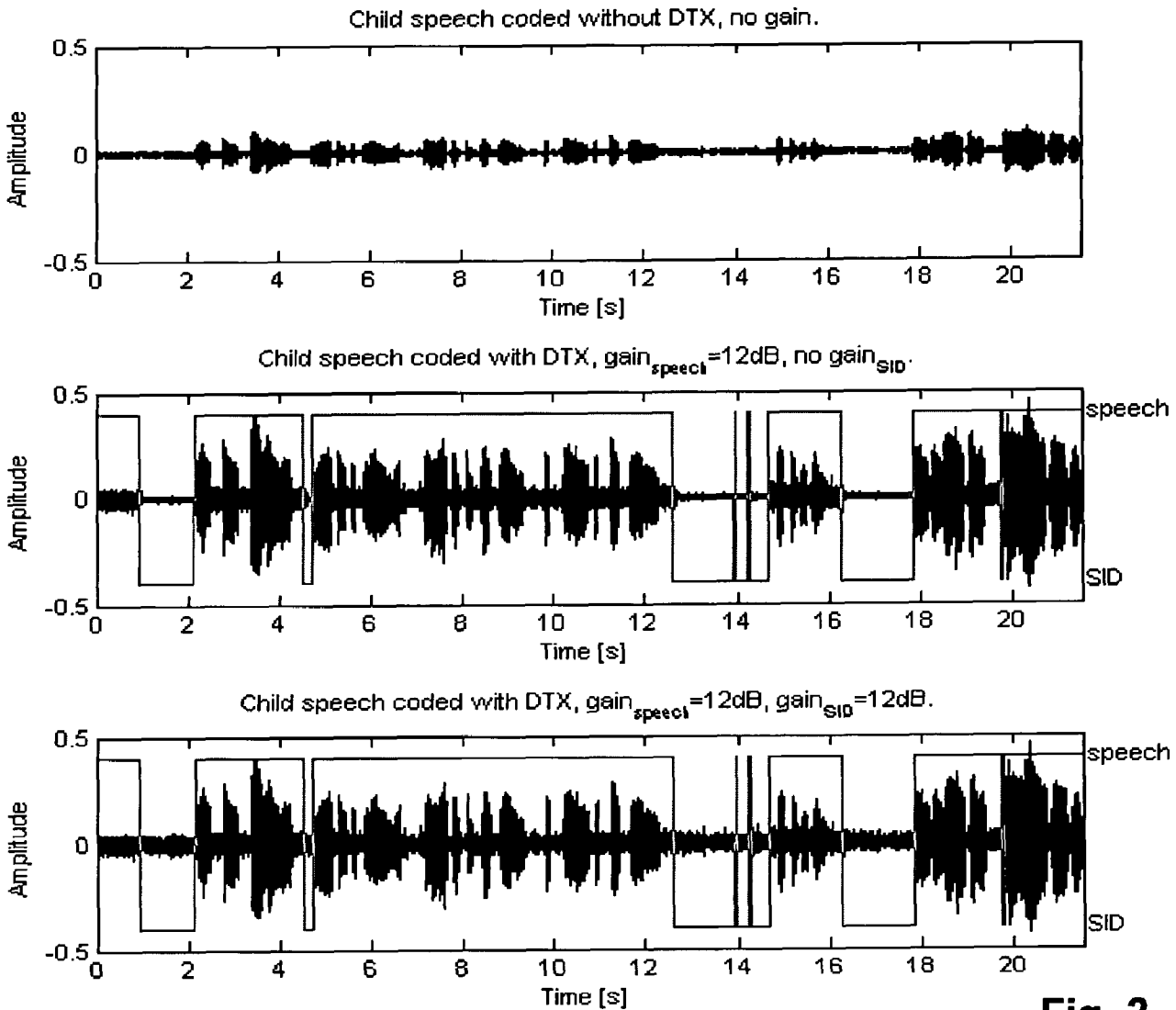
FIG. 2 demonstrates the effect of a DTX operation on a gain manipulation algorithm with noisy child speech samples.

For parameter domain gain control purposes, the information on the level of the background noise is of interest. If the gain level were adjusted only during speech frames, the background noise level would change abruptly at the beginning and end of noise only bursts, as illustrated in FIG. 2. The level changes in the background noise are subjectively very annoying see e.g. Kondoz A. M., University of Surrey, UK, "Digital speech coding for low bit rate communications systems," page 336, John Wiley & Sons, Chichester, 1994. The more annoying the greater the amplification or attenuation is. If the level of speech is adjusted, also the level of the background noise has to be adjusted accordingly to prevent any fluctuations in the background noise level.

At the transmitting side, the frame energy is computed for each frame marked with (Voice Activity Detection) VAD=0 according to the equation:

$$en_{log}(i) = \frac{1}{2}\log_2\left(\frac{1}{N}\sum_{n=0}^{N-1} s^2(n)\right), \tag{1.13}$$

where s(n) is the high-pass filtered input speech signal of the current frame i.

The averaged logarithmic energy is computed by:

$$en_{log}^{mean}(i) = \frac{1}{8}\sum_{n=0}^{7} en_{log}(i-n). \tag{1.14}$$

The averaged logarithmic frame energy is quantized by means of a 6-bit algorithmic quantizer. These 6 bits for the energy index are transmitted in the SID frame.

In the following, gain control in the parameter domain is described.

The fixed codebook gain $g_c$ adjusts the level of the synthesized speech in the AMR speech codec, as can be noticed by studying the equation (1.1) and the speech synthesis model shown in FIG. 1.

The adaptive codebook gain $g_p$ controls the periodicity (pitch) of the synthesized speech, and is limited between [0, 1.2]. As shown in FIG. 1, an adaptive feedback loop transmits the effect of the fixed codebook gain also to the adaptive codebook branch of the synthesis model thereby adjusting also the voiced part of the synthesized speech.

Figure 3:
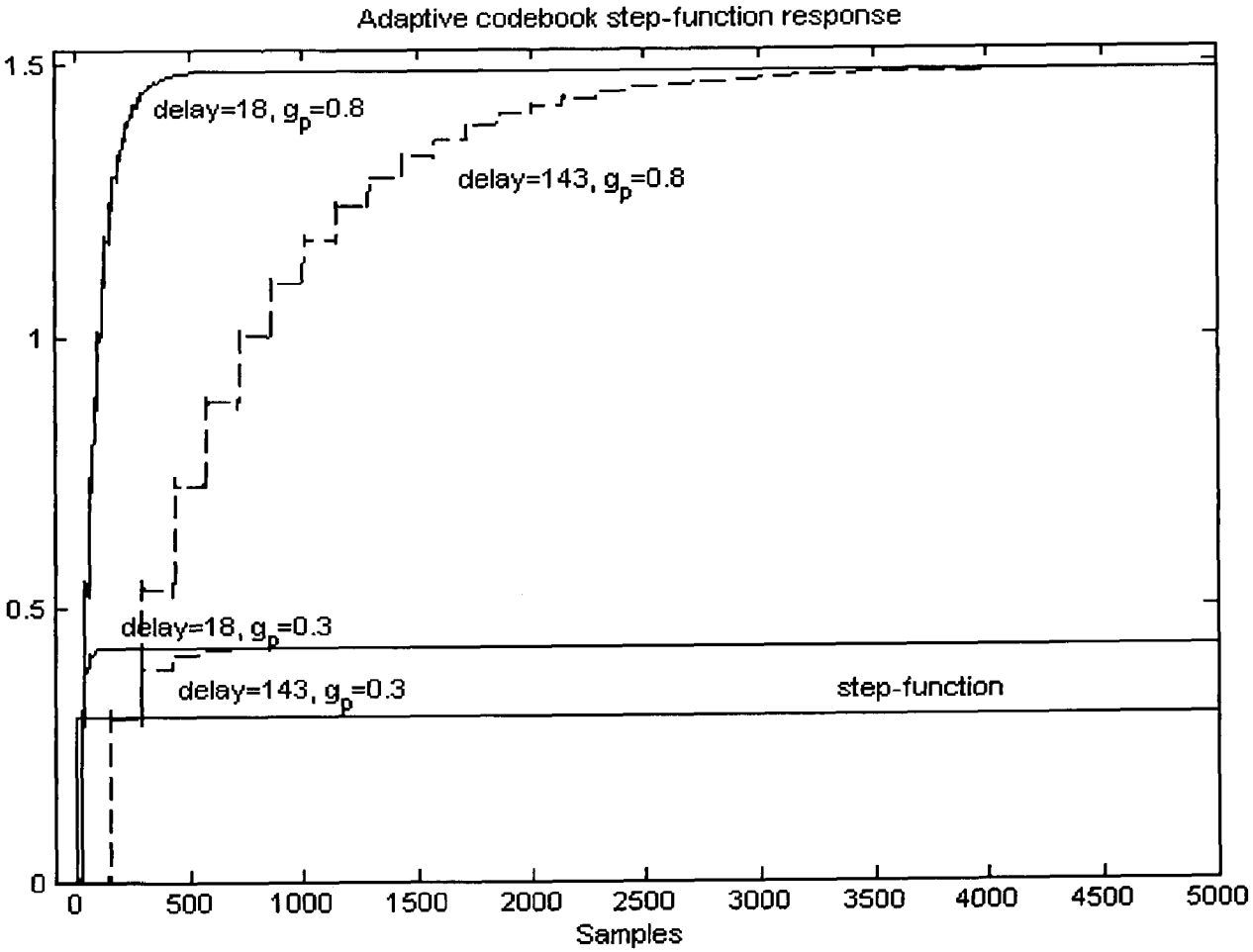
FIG. 3 shows a diagram illustrating a response of an adaptive codebook to a step-function.

The speed at which the change in the fixed codebook gain is transmitted to the adaptive codebook branch depends on the pitch delay T and the pitch gain $g_p$, as illustrated in FIG. 3. The longer the pitch delay and the higher the pitch gain, the longer it takes for the adaptive codebook vector v(n) to stabilize (to reach its corresponding level).

For real speech signals, the pitch gain and delay vary. However, the simulation with a fixed pitch delay and pitch gain tries to give a rough estimate on the limits to the stabilization time of the adaptive codebook after a change in the fixed codebook gain. The pitch delay is limited in AMR between [18, 143] samples, as in the example too, corresponding to high child and low male pitches, respectively.

The pitch gain, however, may have values between [0,1.2]. For zero pitch gain, there is naturally no delay at all. On the other hand, the pitch gain receives values at or above 1 only very short time instants for the adaptive codebook not to go unstable. Therefore, the estimated maximum delay is around few thousand samples, about half a second.

FIG. 3 shows the response of the adaptive codebook to a step-function (sudden change in $g_c$) as a function of pitch delay T (integer lag k in Eq. (1.1)) and pitch gain $g_p$. The output of the scaled fixed codebook, $g_c$*c(n), changes from 0 to 0.3 at time instant 0 samples. The output of the adaptive codebook (and thus also the excitation signal u(n)) reaches its corresponding level after 108 to 5430 samples, for the pitch delays T and pitch gains $g_p$ of the example.

Figure 4:
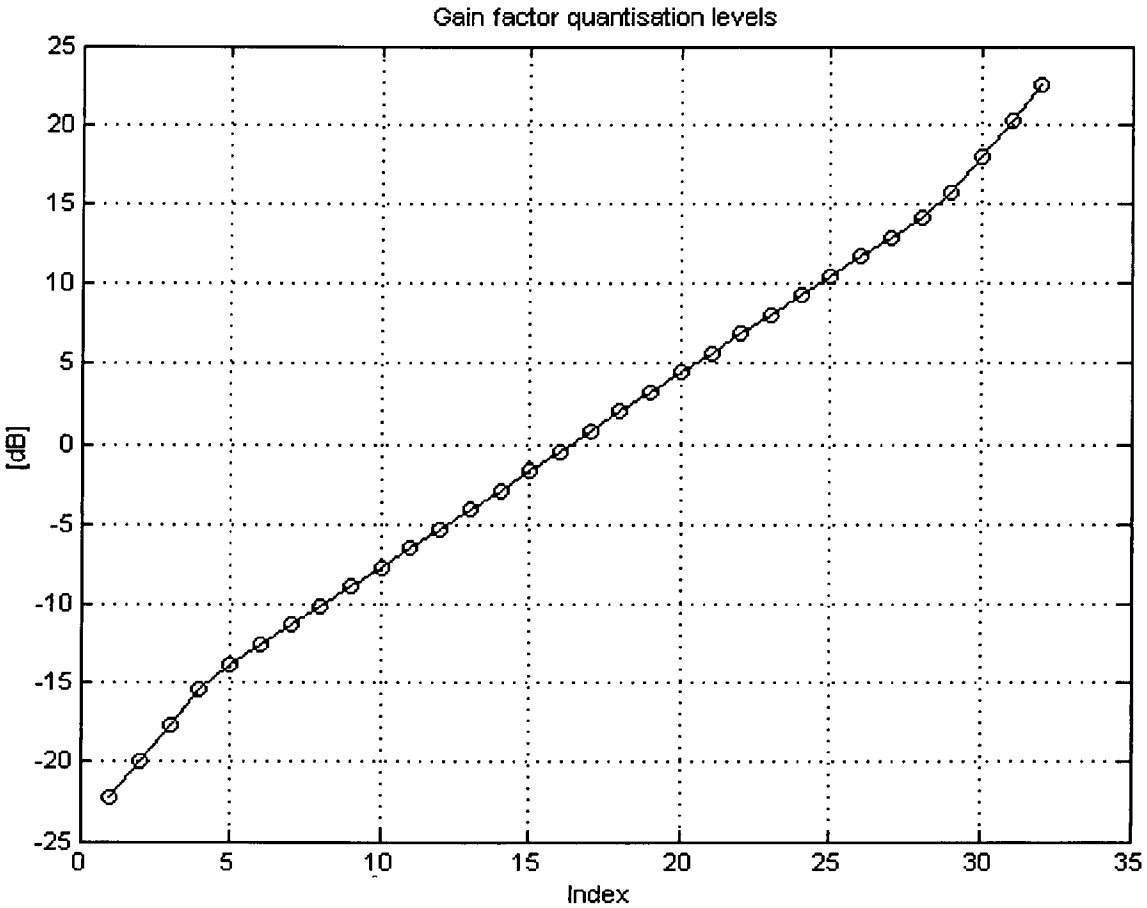
FIG. 4 shows a non-linear 32-level quantization table of a fixed codebook gain factor in modes 12.2 kbit/s and 7.95 kbit/s.
Figure 5:
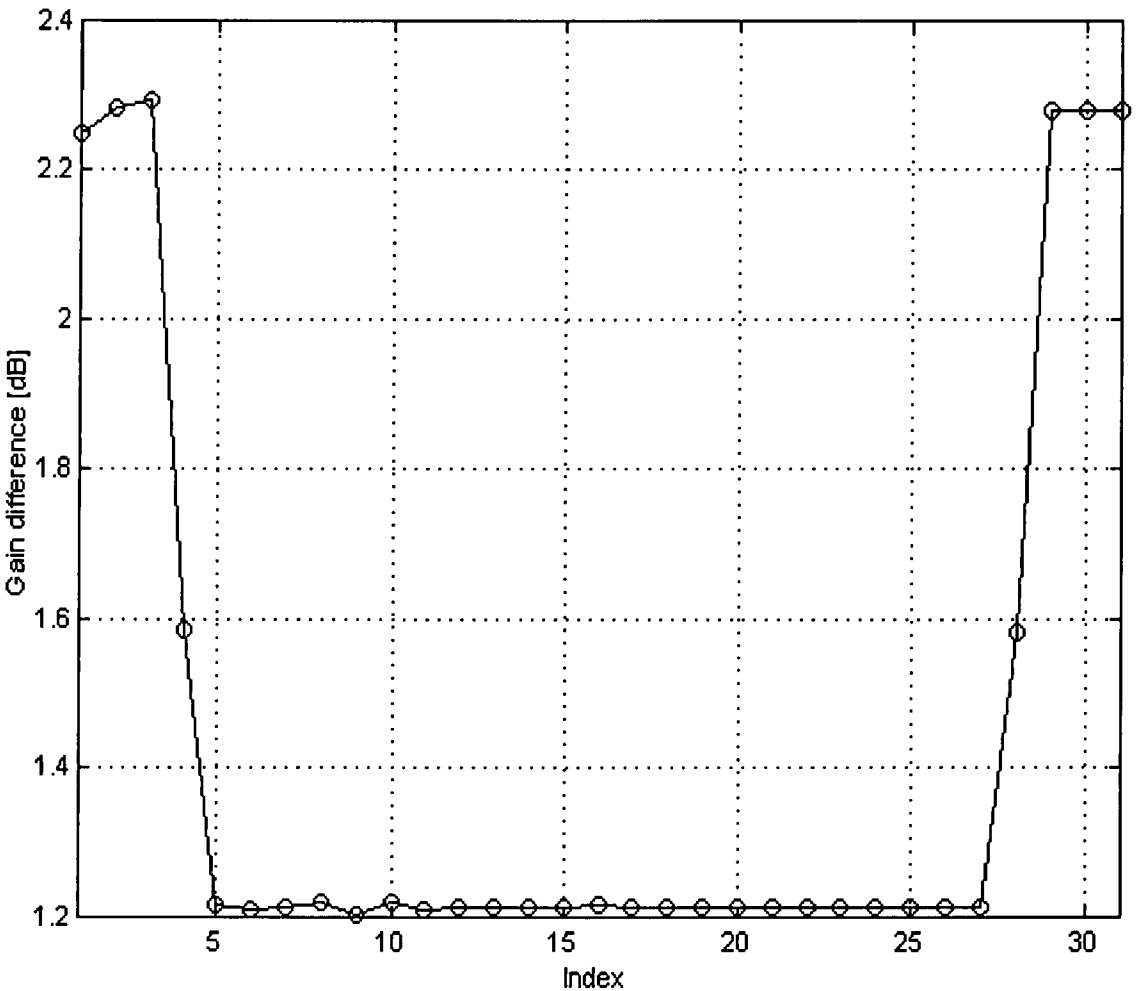
FIG. 5 shows a diagram illustrating the difference between adjacent quantization levels in the quantization table of FIG. 4.

In the highest bit rate mode, 12.2 kbit/s, the fixed codebook gain correction factor $\gamma_{gc}$ is scalar quantized with 5-bits, giving 32 quantization levels, as shown in FIG. 4. The quantization is nonlinear. The quantization steps are shown in FIG. 5. The quantization step is between 1.2 dB to 2.3 dB.

The same quantization table is used in the mode 7.95 kb/s. In all other modes, the fixed codebook gain factor is jointly vector quantized with the adaptive codebook gain. These quantization tables are shown in FIGS. 6 and 7.

The lowest mode 4.75 kbit/s uses vector quantization in a unique way. In the mode 4.75 kbit/s the adaptive codebook gains $g_p$ and the correction factors $\hat{\gamma}_{gc}$ are jointly vector quantized every 10 ms with 6 bits, i.e. two codebook gains of two frames and two correction factors are jointly vector quantized.

FIG. 5 shows a difference between adjacent quantization levels in the quantization table of the fixed codebook gain factor $\gamma_{gc}$ in the modes 12.2 kbit/s and 7.95 kbit/s. The quantization table is approximately linear between indexes 5 and 28. The quantization step in that range is about 1.2 dB.

Figure 6:
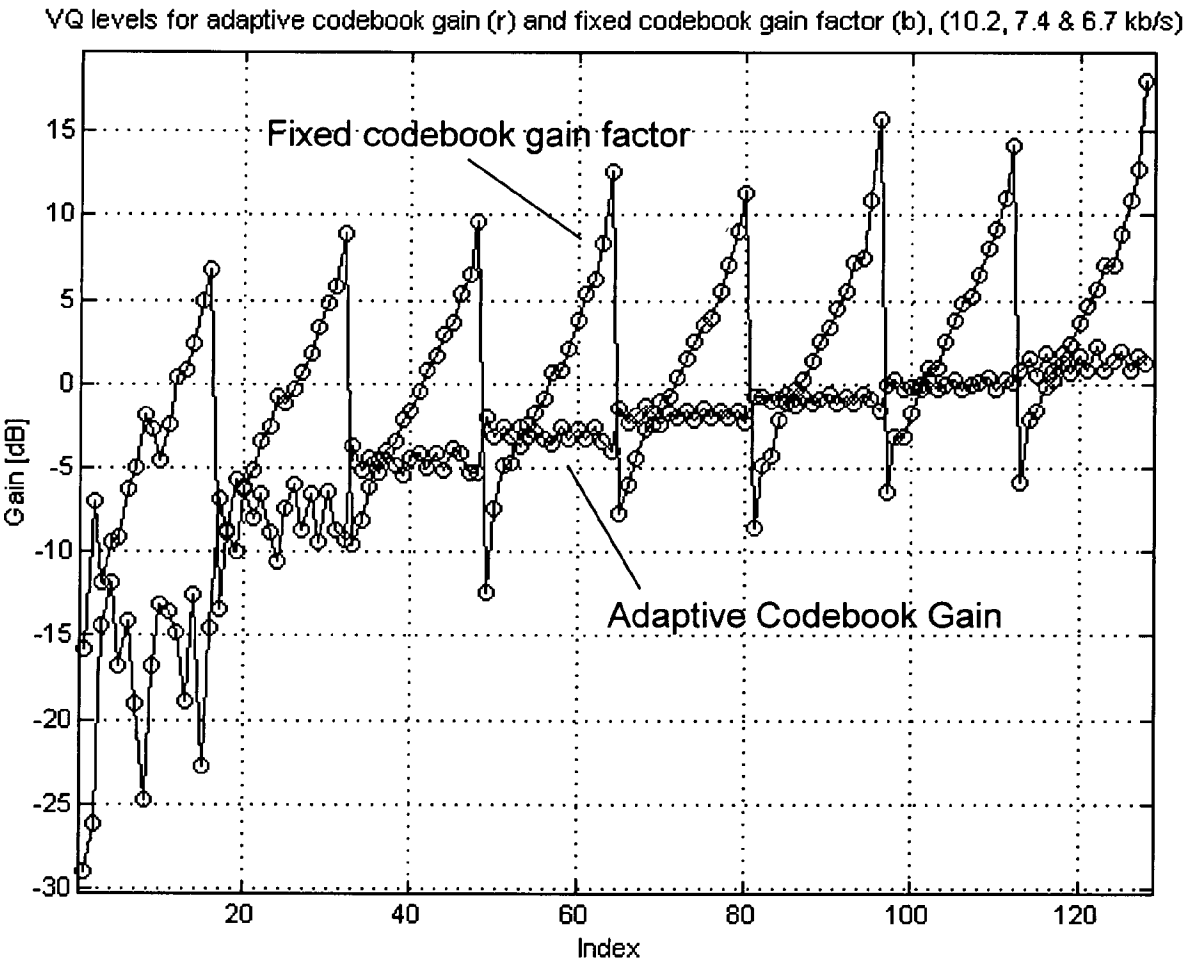
FIG. 6 shows a vector quantization table for an adaptive codebook gain and a fixed codebook gain in modes 10.2, 7.4 and 6.7 kbit/s.
Figure 7:
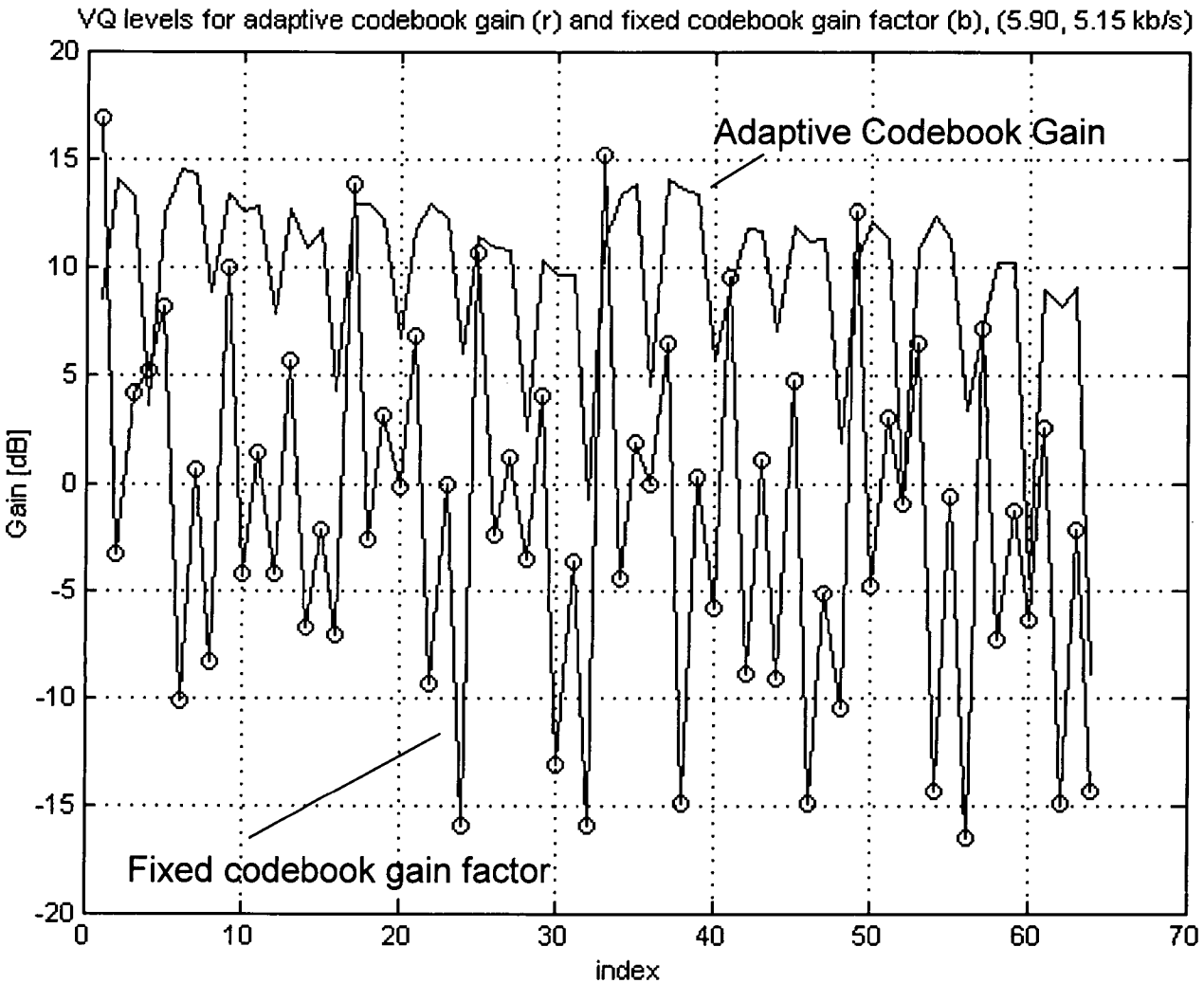
FIG. 7 shows a vector quantization table for an adaptive codebook gain and a fixed codebook gain factor in modes 5.90 and 5.15 kbit/s.

FIG. 6 shows the vector quantization table for the adaptive codebook gain and the fixed codebook gain factor in the modes 10.2, 7.4 and 6.7 kbit/s. The table is printed so that one index value gives both the fixed codebook gain factor and the corresponding (jointly quantized) adaptive codebook gain. As can be seen from FIG. 6, there are approximately 16 levels to choose from for the fixed codebook gain while the adaptive codebook gain remains fairly fixed.

FIG. 7 shows the vector quantization table for the adaptive codebook gain and the fixed codebook gain factor in the modes 5.90 and 5.15 kbit/s. Again, the table is printed so that one index value gives both the fixed codebook gain factor and the corresponding (jointly quantized) adaptive codebook gain.

As explained above, the speech level control in the parameter domain must take place by adjusting the fixed codebook gain. To be more specific, the quantized fixed codebook gain correction factor $\hat{\gamma}_{gc}$ is adjusted, which is one of the speech parameters transmitted to the far-end.

In the following, the relationship between amplification of the fixed codebook gain correction factor and the amplification of the fixed codebook gain is shown. As already shown in Eqs. (1.11) and (1.12), the fixed codebook gain is defined as:

$$\hat{g}_c(n) = \hat{\gamma}_{gc}(n) \cdot 10^{0.05\left[\sum_{i=1}^{4} b_i 20\log_{10}(\hat{\gamma}_{gc}(n-i)) + \bar{E} - E_I\right]}. \tag{2.1}$$

If the fixed codebook gain correction factor $\hat{\gamma}_{gc}(n)$ is amplified by β, at subframe n, and is kept unchanged at least for the following four subframes, the new quantized fixed codebook gain becomes:

$$\begin{aligned}\hat{g}_c^{new}(n) &= \beta\hat{\gamma}_{gc}(n) \cdot 10^{0.05\left[\sum_{i=1}^{4} b_i 20\log_{10}(\hat{\gamma}_{gc}(n-i)) + \bar{E} - E_I\right]} \\ &= \beta\hat{g}_c^{old}(n).\end{aligned} \tag{2.2}$$

In the next subframe, n+1, the new fixed codebook gain becomes:

$$\hat{g}_c^{new}(n+1) = \beta\hat{\gamma}_{gc}(n+1) \cdot 10^{0.05\left[\begin{array}{c} b_i 20\log_{10}(\beta\hat{\gamma}_{gc}((n+1)-1) + \sum_{i=2}^{4} b_i \\ 20\log_{10}(\hat{\gamma}_{gc}((n+1)-i)) + \\ \bar{E} - E_I \end{array}\right]} \tag{2.3}$$

$$\hat{g}_c^{new}(n+1) = \beta\hat{\gamma}_{gc}(n+1) \cdot 10^{0.05\left[\begin{array}{c} b_i 20\log_{10}(\beta) + \sum_{i=1}^{4} b_i \\ 20\log_{10}(\hat{\gamma}_{gc}((n+1)-i)) + \\ \bar{E} - E_I \end{array}\right]} \tag{2.4}$$

$$\begin{aligned}\hat{g}_c^{new}(n+1) &= \beta\hat{\gamma}_{gc}(n+1) \cdot 10^{0.05[b_1 20\log_{10}(\beta)]} \cdot \\ &\quad 10^{0.05\left[\sum_{i=1}^{4} b_i 20\log_{10}(\hat{\gamma}_{gc}((n+1)-i) + \bar{E} - E_I\right]}\end{aligned} \tag{2.5}$$

$$\hat{g}_c^{new}(n+1) = \beta\hat{\gamma}_{gc}(n+1) \cdot \beta^{b_1} 10^{0.05\left[\begin{array}{c} \sum_{i=1}^{4} b_i 20\log_{10}(\hat{\gamma}_{gc} \\ ((n+1)-i)) + \bar{E} - E_I \end{array}\right]} \tag{2.6}$$

$$\hat{g}_c^{new}(n+1) = \beta \cdot \beta^{b_1} \hat{g}_c^{old}(n+1). \tag{2.7}$$

In the same way, in the following subframes, n+2, . . . , n+4, the amplified fixed codebook gain becomes:

$$\hat{g}_c^{new}(n+2) = \beta \cdot \beta^{b_1} \cdot \beta^{b_2} \hat{g}_c^{old}(n+2) \tag{2.8}$$

. . .

$$\hat{g}_c^{new}(n+4) = \beta^{(1+b_1+b_2+b_3+b_4)} \cdot \hat{g}_c^{old}(n+4). \tag{2.9}$$

Since the prediction coefficients were given as $$[b_1\ b_2\ b_3\ b_4] = [0.68\ 0.58\ 0.34\ 0.19],$$

the fixed codebook gain stabilizes after five subframes into a value:

$$\hat{g}_c^{new}(n+4) = \beta^{2.79} \cdot \hat{g}_c^{old}(n+4). \tag{2.10}$$

In other words, multiplying the fixed codebook gain factor with β results in multiplication of the fixed codebook gain (and therefore also the synthesized speech) by $\beta^{2.79}$, assuming that β is held constant at least during the next four frames.

Therefore, e.g. in AMR modes 12.2 kbit/s and 7.95 kbit/s, the minimum change for the fixed codebook gain factor (the minimum quantization step) ±1.2 dB results in ±3.4 dB change in the fixed codebook gain, and hence in the synthesized speech signal, as shown below.

$$20\log_{10}\beta 1.2\text{ dB} \Leftrightarrow \beta = 1.15$$

$$20\log_{10}(\beta^{2.79}) = 3.4\text{dB} \tag{2.11}$$

Figure 8:
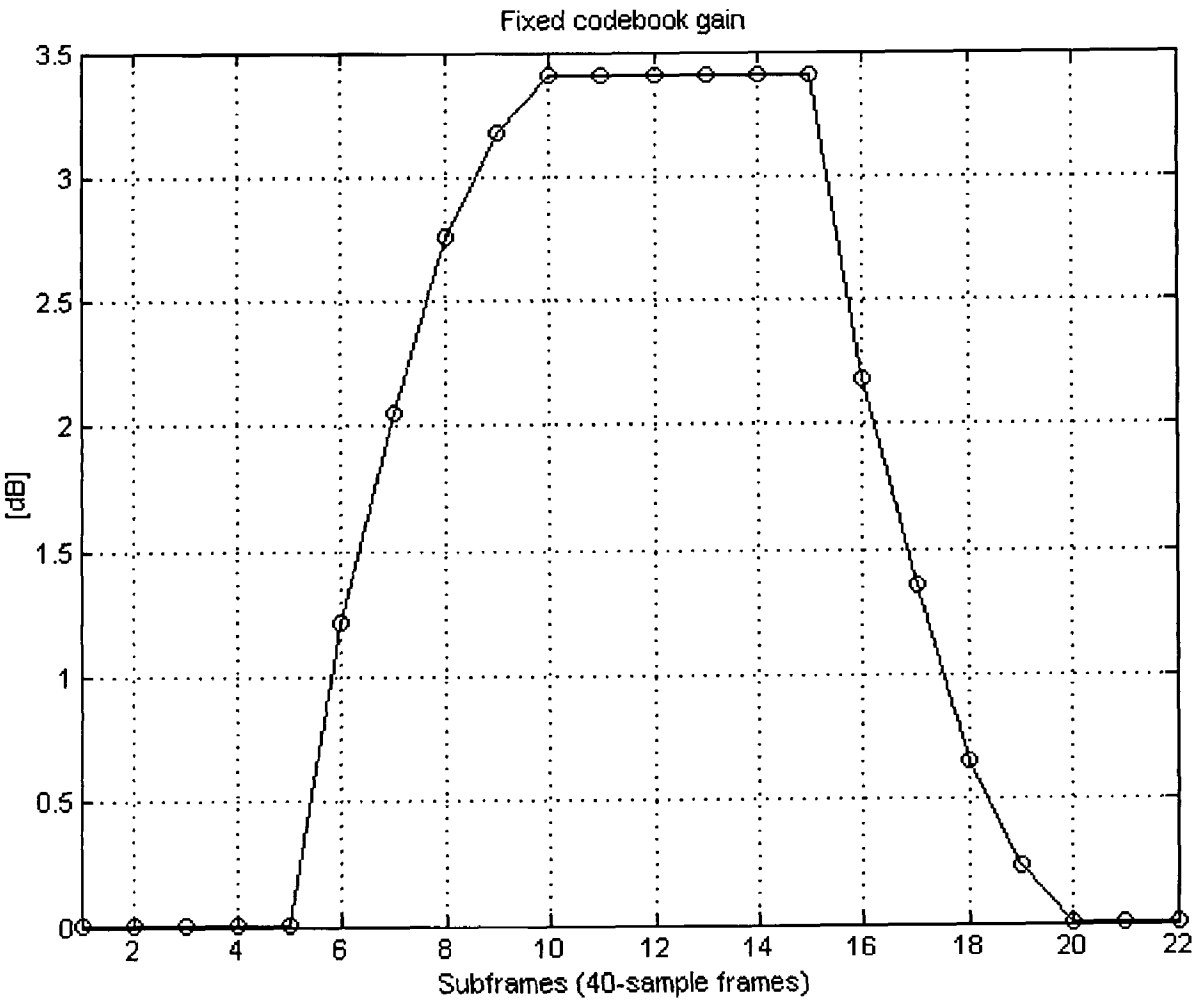
FIG. 8 shows a diagram illustrating a change in the fixed codebook gain when the fixed codebook gain factor is changed one quantization step.

This ±3.4 dB change in the synthesized speech level takes place gradually, as illustrated in FIG. 8.

FIG. 8 shows a change in the fixed codebook gain (AMIR 12.2 kbit/s), when the fixed codebook gain factor is changed one quantization step (in the linear quantization range) first upwards at subframe 6 and then downwards at subframe 16. The 1.2 dB amplification (or attenuation) of the fixed codebook gain factor amplifies (or attenuates) the fixed codebook gain gradually 3.4 dB during 5 subframes (200 samples).

Consequently, the parameter level gain control of coded speech may be made by changing the index value of the fixed codebook gain factor. That is, the index value in the bit stream is replaced by a new value that gives the desired amplification/attenuation. The gain values corresponding to the index changes for AMR mode 12.2 kbit/s are listed in the table below.

TABLE I

Parameter level gain values for AMR 12.2 kbit/s.

| Change in the fixed codebook gain factor index value | Resulting amplification/ attenuation of the speech signal |
|---|---|
| . | . |
| . | . |
| . | . |
| +4 | 13.6 dB |
| +3 | 10.2 dB |
| +2 | 6.8 dB |
| +1 | 3.4 dB |
| 0 | 0 dB |
| −1 | −3.4 dB |
| −2 | −6.8 dB |
| −3 | −10.2 dB |
| −4 | −13.6 dB |
| . | . |
| . | . |
| . | . |

Next, a search for the correct index for the desired change in the overall gain is described by taking into account the nonlinear nature of the fixed codebook gain factor quantization.

The new fixed codebook gain factor quantization index corresponding to the desired amplification/attenuation of the speech signal is found by minimizing the error:

$$|\beta\cdot\hat{\gamma}_{gc}^{old}-\hat{\gamma}_{gc}^{new}|, \tag{2.12}$$

where $\hat{\gamma}_{gc}^{old}$ and $\hat{\gamma}_{gc}^{new}$ are the old and the new fixed codebook gain correction factors and $\beta$ is the desired multiplier:

$\beta=\Delta^{j}, j=[\ .\ .\ .\ -4,-3,\ .\ .\ .\ 0,\ .\ .\ .\ +3,+4,\ .\ .\ .\ ], \Delta$=minimum quantization step (1.15 in AMR 12.2 kbit/s)). Note that the speech signal becomes amplified/attenuated with $\beta^{2.79}$.

Figure 9:
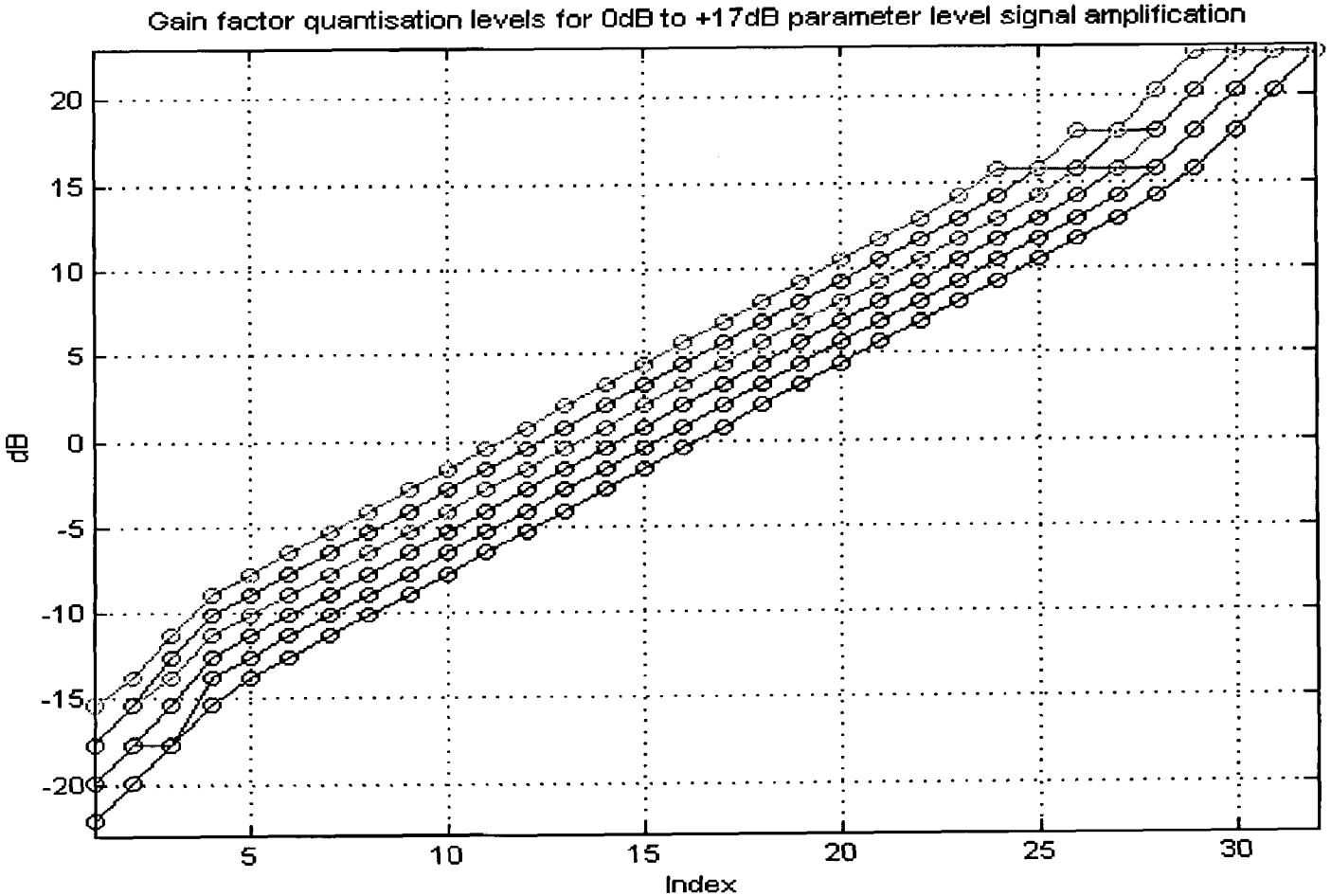
FIGS. 9 and 10 show diagrams illustrating re-quantized levels of the fixed codebook gain factor.
Figure 10:
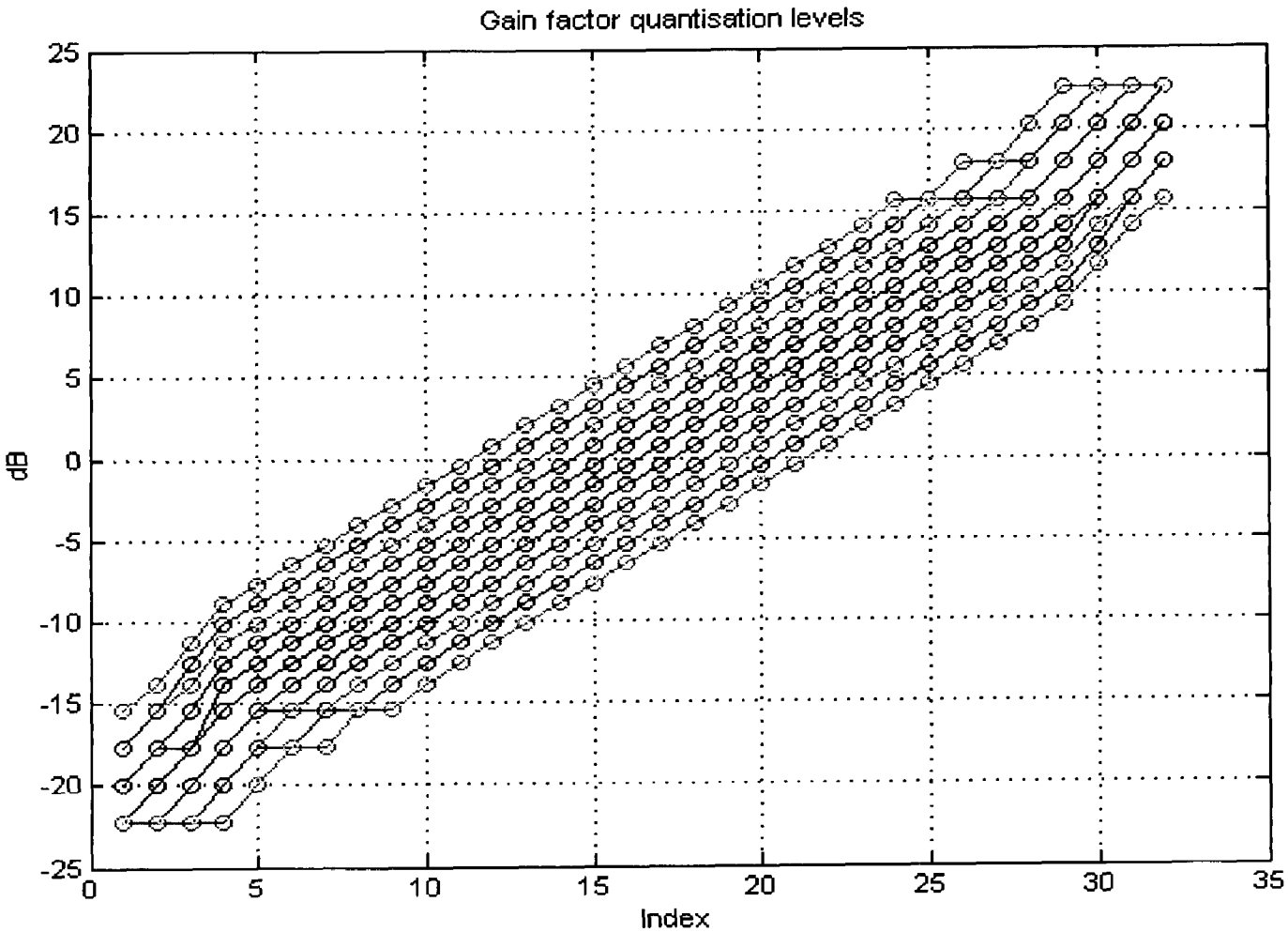

FIG. 9 shows the re-quantized levels for cases +3.4, +6.8, +10.2, +13.6 and +17.0 dB signal amplification achieved with the above error minimization procedure. FIG. 10 shows also the quantization levels in cases of signal attenuation. Both figures show the quantization levels for the AMR mode 12.2 kbit/s.

In FIG. 9 the lowest curve shows the original quantization levels of the fixed codebook gain factor. The second lowest curve shows re-quantized levels of the fixed codebook gain factor in the case of +3.4 dB signal level amplification, and the subsequent curves show re-quantized levels of the fixed codebook gain factor in cases +6.8, +10.2, +13.6 and +17 dB signal level amplification, respectively.

FIG. 10 shows re-quantized levels of the fixed codebook gain factor in cases: −17, −13.6, . . . , −3.4, 0,+3.4, . . . , +13.6, +17 dB signal level amplification. The curve in the middle shows the original quantization levels of the fixed codebook gain factor.

In AMR modes 10.2 kbit/s, 7.40 kbit/s, 6.70 kbit/s, 5.90 kbit/s, 5.15 kbit/s and 4.75 kbit/s, the equation 2.12 is replaced by:

$$|\beta\cdot\hat{\gamma}_{gc}^{old}-\hat{\gamma}_{gc}^{new}+\text{weight}\cdot|\bar{g}_{p\,new}-\bar{g}_{p\,old}|, \tag{2.13}$$

where the weight is $\geqq 1$, and $\bar{g}_{p\,new}$ and $\bar{g}_{p\,old}$ are the new and old adaptive codebook gains, respectively.

In other words, in modes 12.2 kbit/s and 7.95 kbit/s, the new fixed codebook gain factor index is found as the index which minimizes the error given in Eq. (2.12). In modes 10.2 kbit/s, 7.40 kbit/s, 6.70 kbit/s, 5.90 kbit/s, 5.15 kbit/s and 4.75 kbit/s the new joint index of the vector quantized fixed codebook gain factor and adaptive gain is found as the index which minimized the error given in Eq. (2.13). The rationale behind the Eq. (2.13) is to be able to change the fixed codebook gain factor without introducing audible error to the adaptive codebook gain. FIG. 6 shows the vector quantized fixed codebook gain factors and adaptive codebook gains at different index values. From FIG. 6 it can be seen that there is a possibility to change the fixed codebook gain factor without having to change the adaptive codebook gain excessively.

As mentioned above, in the mode 4.75 kbit/s the adaptive codebook gains $g_p$ and the correction factors $\hat{\gamma}_{gc}$ are jointly vector quantized every 10 ms with 6 bits, i.e. two codebook gains of two subframes and two correction factors are jointly vector quantized. The codebook search is done by minimizing a weighted sum of the error criterion for each of the two subframes. The default values of the weighing factors are 1. If the energy of the second subframe is more than two times the energy of the first subframe, the weight of the first subframe is set to 2. If the energy of the first subframe is more than four times the energy of the second subframe, the weight of the second subframe is set to 2. Despite of these differences, the mode 4.75 kbit/s can be processed with the vector quantization schema described above.

Thus, according to the above-described embodiment, a new gain index (new index value) minimizing the error between the desired gain $\beta\cdot\hat{\gamma}_{gc}^{old}$ (enhanced first parameter value) and the realized effective gain $\hat{\gamma}_{gc}^{new}$ (new first parameter value) according to Eq. (2.12) or (2.13) is determined according to the quantization tables for the respective modes. The new fixed codebook gain correction factor (and the new adaptive codebook gain in case of modes other than 12.2 kbits/s and 7.95 kbit/s) correspond to the determined new gain index. The old gain index (current index value) representing the old fixed codebook gain correction factor $\hat{\gamma}_{gc}^{old}$ (current first parameter value) (and the old adaptive codebook gain $\bar{g}_{p\,old}$ (current second parameter value) in case of modes other than 12.2 kbits/s and 7.95 kbit/s) then is replaced by the new gain index.

In the following, alternative methods for providing an improved gain accuracy are described. At first it is illustrated how the total desired gain is formulated in case the gain is not kept constant during five consecutive subframes.

As described above, in the AMR-codec, the fixed codebook gain is encoded using the fixed codebook gain correction factor $\gamma_{gc}$. The gain correction factor is used to scale the predicted fixed codebook gain $g_c'$ to obtain the fixed codebook gain $g_c$, i.e.

$$g_c = \gamma_{gc} g_c' \Rightarrow \gamma_{gc} = \frac{g_c}{g_c'}. \tag{2.14}$$

The fixed codebook gain is predicted as follows:

$$g_c'(n) = 10^{0.05\left[\sum_{i=1}^{4} b_i 20\log_{10}(\hat{\gamma}_{gc}(n-i))+E-E_I\right]} \tag{3.1}$$

where $\bar{E}$ is a mode dependent energy value (in dB) and $E_1$ is the fixed codebook excitation energy (in dB).

To obtain a desired overall signal gain $\alpha$, the quantified fixed codebook correction factor has to be multiplied by a correction factor gain $\beta$. Realized correction factor gains are denoted with $\hat{\beta}(n-i)$, $i>0$. By amplifying the fixed codebook correction factor $\hat{\gamma}_{gc}(n)$ with $\beta(n)$, at subframe n, the new quantized fixed codebook gain becomes: (Note that the prediction $g_c'$ depends on the history of the correction gains, as shown in Equation 2.14)

$$\hat{g}_c^{new}(n) = \beta(n)\hat{\gamma}_{gc}(n)g_c'^{new}(n)$$

$$\hat{g}_c^{new}(n) = \beta(n)\hat{\gamma}_{gc}(n)\cdot 10^{0.05\left[\sum_{i=1}^{4} b_i 20\log_{10}(\hat{\beta}(n-i)\hat{\gamma}_{gc}(n-i))+\bar{E}-E_I\right]}$$

$$\hat{g}_c^{new}(n) = \beta(n)\hat{\gamma}_{gc}(n)\cdot 10^{\sum_{i=1}^{4} b_i\log_{10}(\hat{\beta}(n-i)\hat{\gamma}_{gc}(n-i))+0.05\bar{E}-0.05E_I}$$

$$\hat{g}_c^{new}(n) = \beta(n)\hat{\gamma}_{gc}(n)\cdot 10^{\sum_{i=1}^{4} b_i(\log_{10}(\hat{\beta}(n-i))+\log_{10}(\hat{\gamma}_{gc}(n-i)))+0.05\bar{E}-0.05E_I}$$

$$\hat{g}_c^{new}(n) = \beta(n)\hat{\gamma}_{gc}(n)\cdot 10^{\sum_{i=1}^{4} b_i\log_{10}(\hat{\beta}(n-i))}10^{\sum_{i=1}^{4} b_i\log_{10}(\hat{\gamma}_{gc}(n-i))+0.05\bar{E}-0.05E_I}$$

$$\hat{g}_c^{new}(n) = \beta(n)\cdot 10^{\sum_{i=1}^{4} b_i\log_{10}(\hat{\beta}(n-i))}\cdot\hat{\gamma}_{gc}(n)\cdot 10^{0.05\left[\sum_{i=1}^{4} b_i 20\log_{10}(\hat{\gamma}_{gc}(n-i))+\bar{E}-E_I\right]}$$

$$\hat{g}_c^{new}(n) = \beta(n)\cdot 10^{\sum_{i=1}^{4} b_i\log_{10}(\hat{\beta}(n-i))}\cdot\hat{\gamma}_{gc}(n)g_c'(n)$$

Therefore, a new prediction, which is obtained using the realized factor gains $\hat{\beta}(n-i)$, can be written as $$g_c'^{new} = 10^{\sum_{i=1}^{4} b_i\log_{10}(\hat{\beta}(n-i))}g_c'.$$

Furthermore, $$\hat{g}_c^{new}(n) = \hat{\beta}(n)\cdot 10^{\sum_{i=1}^{4} b_i\log_{10}(\hat{\beta}(n-i))}\cdot\hat{\gamma}_{gc}(n)g_c'(n)$$

$$\hat{g}_c^{new}(n) = 10^{\log_{10}\hat{\beta}(n)}\cdot 10^{\sum_{i=1}^{4} b_i\log_{10}(\hat{\beta}(n-i))}\cdot\hat{\gamma}_{gc}(n)g_c'(n)$$

$$\hat{g}_c^{new}(n) = 10^{\sum_{i=0}^{4} b_i\log_{10}(\hat{\beta}(n-i))}\cdot\hat{\gamma}_{gc}(n)g_c'(n),\ b_o = 1$$

$$\hat{g}_c^{new}(n) = \alpha g_c(n).$$

i.e., the target correction factor gain for the present subframe can be written as $$\alpha = 10^{\sum_{i=0}^{4} b_i\log_{10}(\hat{\beta}(n-i))} \Leftrightarrow \hat{\beta}(n) = \frac{\alpha}{10^{\sum_{i=1}^{4} b_i\log_{10}(\hat{\beta}(n-i))}}.$$

If $\hat{\beta}(n)$ is kept constant, the overall gain stabilizes after five subframes into a value $$\alpha = 10^{\sum_{i=0}^{4} b_i\log_{10}(\hat{\beta})}$$

$$= 10^{\log_{10}(\hat{\beta})\sum_{i=0}^{4} b_i}$$

-continued $$= \hat{\beta}^{\sum_{i=0}^{4} b_i}$$

$$= \hat{\beta}^{2.79} \Leftrightarrow \hat{\beta}$$

$$= \alpha^{\frac{1}{2.79}}$$

$$= a,$$

because the prediction coefficients were given as b=[1,0.68, 0.58,0.34,0.19].

Next, a first alternative of the above described gain manipulation is described, which first alternative is referred to as Synthesizing Error Minimization (synthesizing method).

The algorithm according to the synthesizing method follows as much as possible the original error criteria given for the scalar quantization as $$E_{SQ}=(g_c-\hat{g}_c)^2=(g_c-\hat{\gamma}_{gc}g_c')^2,$$

where $E_{SQ}$ is the fixed codebook quantization error and $g_c$ is the target fixed codebook gain. As mentioned before, the goal is to scale the fixed codebook gain with the desired total gain $g_c^{new}=\alpha\hat{g}_c$. Therefore, for the CDALC (Coded Domain Automatic Level Control) purposes, the target must be scaled by the desired gain, i.e.

$$E_{SQ}=(\alpha\hat{g}_c-\hat{\gamma}_{gc}^{new}g_c'^{new})^2. \tag{3.2}$$

In the vector quantization, the pitch gain $g_p$ and the fixed codebook correction factor $\hat{\gamma}_{gc}$ are jointly quantized. In the AMR encoder, the vector quantization index is found by minimizing the quantization error $E_{VQ}$ defined as $$E_{VQ}=\|x-\hat{g}_p y-\hat{g}_c z\|,$$

where x,y and z are a target vector, a weighted LP-filtered adaptive codebook vector and a weighted LP-filtered fixed codebook vector, respectively. The error criterion is actually a norm of the perceptually weighted error between the target and the synthesized speech. Following the procedure of the scalar quantization, the target vector is replaced by the scaled version, i.e.

$$E_{VQ}=\|(\hat{g}_p y^{new}+\alpha\hat{g}_c z)-\hat{g}_p^{new}y^{new}-\hat{g}_c^{new}z\|. \tag{3.3}$$

In the following, the synthesizing method is described for the scalar quantization.

The derivation of the minimization criterion is started from the Equation 3.2 used in the AMR-encoder and given as:

$$E_{SQ}=(\alpha g_c-\hat{\gamma}_{gc}^{new}g_c'^{new})^2.$$

Unfortunately, there is no direct access to $g_c$, however it can be approximated by $g_c\approx\hat{\gamma}_{gc}g_c'$ and therefore the first CDALC error criterion for the scalar quantization can be written as $$E_{SQ} = (\alpha\hat{\gamma}_{gc}g_c' - \hat{\gamma}_{gc}^{new}g_c'^{new})^2 \tag{3.4}$$

$$E_{SQ} = \left(\alpha\hat{\gamma}_{gc}g_c' - \hat{\gamma}_{gc}^{new}10^{\sum_{i=1}^{4} b_i log_{10}(\hat{\beta}(n-i))}g_c'\right)^2$$

$$E_{SQ} = g_c'^2\left(\alpha\hat{\gamma}_{gc} - 10^{\sum_{i=1}^{4} b_i log_{10}(\hat{\beta}(n-i))}\gamma_{gc}^{new}\right)^2 \Leftrightarrow$$

$$E_{SQ'} = \left|\alpha\hat{\gamma}_{gc} - 10^{\sum_{i=1}^{4} b_i log_{10}(\hat{\beta}(n-i))}\gamma_{gc}^{new}\right|$$

where $\hat{\beta}(n-i)$ is the realized correction factor gain for the subframe (n−i), i.e.

$$\hat{\beta}(n-i) = \frac{\hat{\gamma}_{gc}^{new}(n-i)}{\hat{\gamma}_{gc}(n-i)}.$$

This error criterion is simple to evaluate and only the fixed codebook correction factor has to be decoded. Furthermore, four previous realized correction factor gains have to be kept in the memory.

Next, the synthesizing method is described for the vector quantization.

For the vector quantization case the error criterion used in the AMR-encoder is more complicated, since the synthesis filters are used. In view of the fact that there is no direct access to the target x, it is approximated by $\hat{g}_p y + \hat{g}_c z$. Thus, the error minimization with CDALC becomes:

$$E_{VQ} = \|x^{new} - \hat{g}_p^{new} y^{new} - \hat{g}_c^{new} z\| \tag{3.5}$$

$$E_{VQ} = \|(\hat{g}_p \alpha y + \alpha \hat{g}_c z) - \hat{g}_p^{new} \alpha y - \hat{g}_c^{new} z\|$$

$$E_{VQ} = \|(\hat{g}_p - \hat{g}_p^{new})\alpha y + (\alpha \hat{g}_c - \hat{g}_c^{new})z\|$$

$$E_{VQ} = \|(\hat{g}_p - \hat{g}_p^{new})\alpha y + (\alpha \hat{\gamma}_{gc} g_c' - \hat{\gamma}_{gc}^{new} g_c'^{new})z\|$$

$$E_{VQ} = \|(\hat{g}_p - \hat{g}_p^{new})\alpha y + g_c'(\alpha \hat{\gamma}_{gc} - \hat{\gamma}_{gc}^{new} 10^{\sum_{i=1}^{4} b_i \log_{10}(\hat{\beta}(n-i))})z\|.$$

In addition to decoding the gains, both codebook vectors have to be decoded and filtered with the LP-synthesis filter. Therefore, LP-synthesis filter parameters have to be decoded. This means that basically all the parameters have to be decoded. In the AMR-encoder the codebook vectors are also weighted by a specific weighting filter, but this was not done for this CDALC error criterion.

Next, a second alternative of the gain manipulation is described, which second alternative is referred to as Quantization Error Minimization with Memory (memory method).

This criterion minimizes quantization error while taking in account the history of the previous correction factors. In case of scalar quantization the error criterion is the same as in the first alternative, i.e. the error function to be minimized will be the same as in Equation 3.4. But for the vector quantization the error function becomes little easier to evaluate.

Vector Quantization

Starting from the error function derived for the first alternative and given in Equation 3.5, minimizing the error of the sum of two components will require decoding the y and z vectors. Practically this means that the whole signal has to be decoded. Instead of minimizing the norm, of the error vector, the error can be approximated by the sum of two error components (which would be the case if both vectors y and z are parallel to each other), namely the pitch gain error and the fixed codebook gain error. Combining these components using the Euclidean norm, the new error criteria can be written as:

$$E_{VQ'} = \sqrt{\|(\hat{g}_p - \hat{g}_p^{new})\alpha y\|^2 + \left\| g_c'\left(\alpha \hat{\gamma}_{gc} - \hat{\gamma}_{gc}^{new} 10^{\sum_{i=1}^{4} b_i \log_{10}(\hat{\beta}(n-i))}\right) z \right\|^2} \tag{3.6}$$

-continued $$E_{VQ'} = \sqrt{|\hat{g}_p - \hat{g}_p^{new}|^2 \|\alpha y\|^2 + \left|\alpha \hat{\gamma}_{gc} - \hat{\gamma}_{gc}^{new} 10^{\sum_{i=1}^{4} b_i \log_{10}(\hat{\beta}(n-i))}\right|^2 g_c'^2 \|z\|^2} \Rightarrow$$

$$E_{VQ''} = |\hat{g}_p - \hat{g}_p^{new}|^2 \left(\frac{\alpha \|y\|}{g_c' \|z\|}\right)^2 + \left|\alpha \hat{\gamma}_{gc} - \hat{\gamma}_{gc}^{new} 10^{\sum_{i=1}^{4} b_i \log_{10}(\hat{\beta}(n-i))}\right|^2.$$

The sum of the previous equation (Equation 3.5) is divided into two components. However, the synthesized codebook vectors still exist in the pitch gain error scaling term $$\left(\frac{\alpha \|y\|}{g_c' \|z\|}\right)^2.$$

Due to the synthesis, the pitch gain error scaling term is complicate to compute. If it is computed, it would be more efficient to use the synthesization error minimization criterion described in the first alternative. To get rid of the synthesis-procedure, the term $$\frac{\|y\|}{\|z\|}$$

is replaced by the constant pitch gain error weight $w_{g_p}$. The pitch gain error weight has to be chosen carefully. If the weight is chosen to be too big, the signal level will not change at all, since the lowest error is found by choosing $g_p^{new} = g_p$. On the other hand, a small weight will guarantee the desired codebook gain $\alpha$, but it will give no guarantees for $g_p$, i.e.

$$w_{g_p} \to 0 \Rightarrow \text{minimization of term } \left|\alpha \hat{\gamma}_{gc} - \hat{\gamma}_{gc}^{new} 10^{\sum_{i=1}^{4} b_i \log_{10}(\hat{\beta}(n-i))}\right|^2.$$

$$w_{g_p} \to \infty \Rightarrow \text{minimization of term } |g_p^{old} - g_p^{new}|^2$$

This algorithm using fixed pitch gain weight requires decoding (finding a value according to the received quantization index) of both the pitch gain and the correction factor ($\hat{\gamma}_{gc}$) and also reconstructing of the fixed codebook gain prediction $g_c'$. To be able to construct the prediction, the fixed codebook vector has to be decoded. Furthermore, the integer pitch lag is needed for the pitch sharpening of the fixed codebook excitation. The energy of the fixed codebook excitation is required for the prediction (see Equation 3.1). If necessary, the prediction can be included in the fixed weight, i.e.

$$w_{g_p} = \frac{\|y\|}{g_c' \|z\|}.$$

After that there is no need to decode the fixed codebook vector. Presumably, it would not affect much in performance. On the other hand, the energy of the fixed codebook excitation can be estimated, since it is fairly fixed. This allows the creation of a prediction without decoding the fixed codebook vector.

Figure 11:
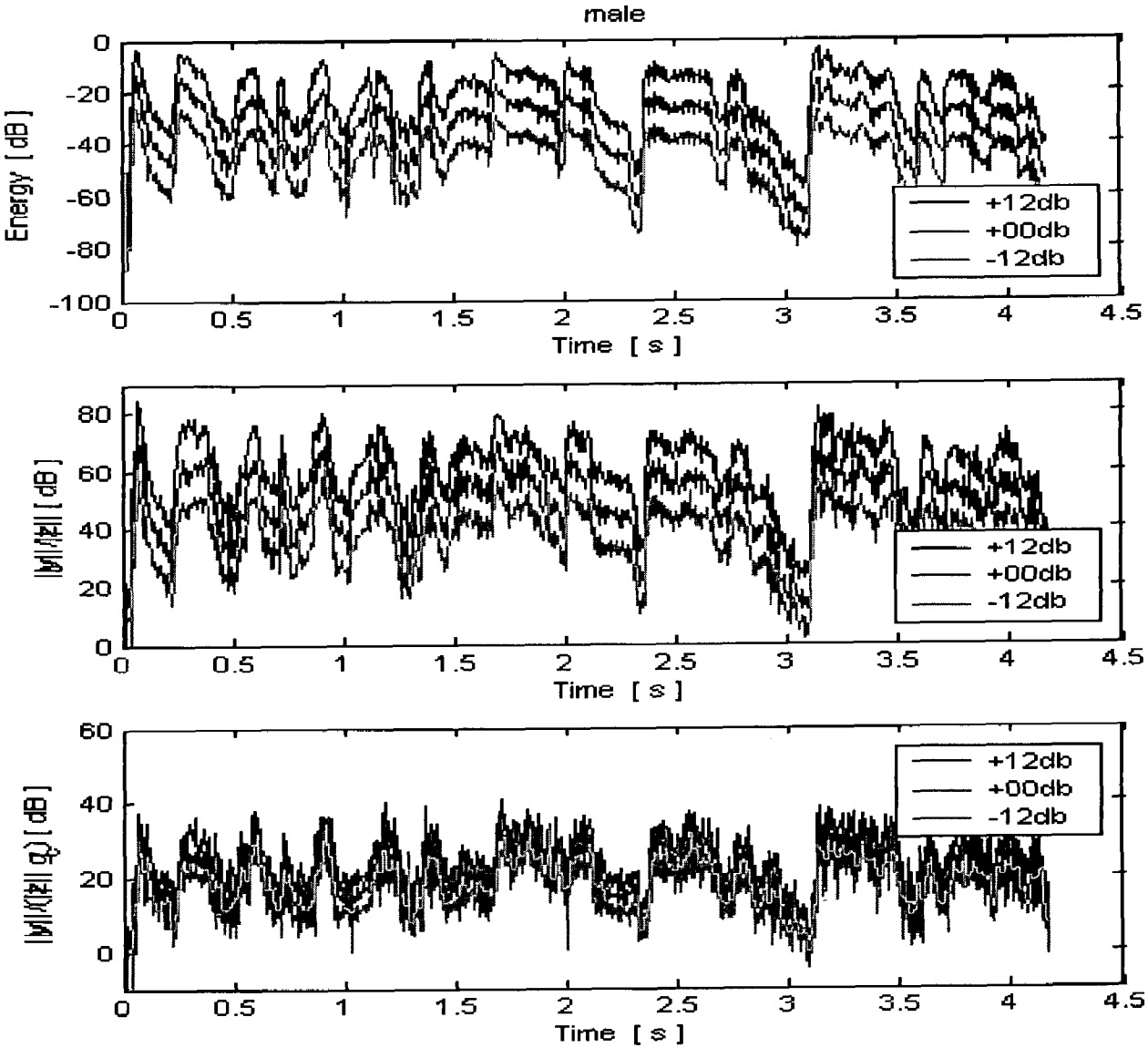
FIG. 11 illustrates values of terms $$\frac{\|y\|}{\|z\|} \text{ and } \frac{\|y\|}{g_c'\|z\|}$$

The range of the terms $$\frac{\|y\|}{\|z\|} \text{ and } \frac{\|y\|}{g_c'\|z\|}$$

are demonstrated in FIGS. 11 and 12 with male and child speech samples using AMR mode 12.2 kbit/s. The value depends strongly on the energy of the signal. Hence, it would be beneficial to make the pitch gain error weight $w_{g_p}$ adaptive instead of using a constant value. For example, the value may be determined using short time signal energy.

FIG. 13 shows a flow chart generally illustrating the method of enhancing a coded audio signal comprising coded speech and/or coded noise according to the invention. The coded audio signal comprises indices which represent speech parameters and/or noise parameters which comprise at least a first parameter for adjusting a first characteristic of the audio signal, such as the level of synthesized speech and/or noise.

In step S1 in FIG. 13 a current first parameter value is determined from an index corresponding to at least the first parameter, e.g. the fixed codebook gain correction factor $\hat{\gamma}_{gc}$. In step S2 the current first parameter value is adjusted, e.g. multiplied by a, in order to achieve an enhanced first characteristic, thereby obtaining an enhanced first parameter value $a\cdot\hat{\gamma}_{gc}^{old}$. Finally, in step S3 a new index value is determined from a table relating index values to at least first parameter values, e.g. a quantization table, such that a new first parameter value corresponding to the new index value substantially matches the enhanced first parameter value.

According to the above-described embodiment, a new index value for $a\cdot\hat{\gamma}_{gc}^{old}$ is searched such that the equation $|\alpha\cdot\hat{\gamma}_{gc}^{old}-\hat{\gamma}_{gc}^{new}|$ is minimized, $\hat{\gamma}_{gc}^{new}$ being the new first parameter value corresponding to the searched new index value.

Moreover, according to the present invention, a current second parameter value may be determined from the index further corresponding to a second parameter such as the adaptive codebook gain controlling a second characteristic of speech. In this case, the new index value is determined from the table further relating the index values to second parameter values, e.g. a vector quantization table, such that a new second parameter value corresponding to the new index value substantially matches the current second parameter value.

According to the above-described embodiment, a new index value for $a\cdot\hat{\gamma}_{gc}^{old}$ and $g_p^{old}$ is searched such that the equation $|\alpha\cdot\hat{\gamma}_{gc}^{old}-\gamma_{gc}^{new}|+\text{weight}\cdot|g_p^{new}-g_p^{old}|$ is minimized. $g_p^{new}$ is the new second parameter value corresponding to the new index value.

"weight" can be $\geqq 1$, so that the new index value is determined from the table such that substantially matching the current second parameter value has precedence.

FIG. 14 shows a schematic block diagram illustrating an apparatus 100 for enhancing a coded audio signal according to the invention. The apparatus receives a coded audio signal which comprises indices which represent speech and/or noise parameters which comprise at least a first parameter for adjusting a first characteristic of the audio signal. The apparatus comprises a parameter value determination block 11 for determining a current first parameter value from an index corresponding to at least the first parameter, an adjusting block 12 for adjusting the current first parameter value in order to achieve an enhanced first characteristic, thereby obtaining an enhanced first parameter value, and an index value determination block 13 for determining a new index value from a table relating index values to at least first parameter values, such that a new first parameter value corresponding to the new index value substantially matches the enhanced first parameter value.

The parameter value determination block 11 may further determine a current second parameter value from the index further corresponding to a second parameter, and the index value determination block 13 may then determine the new index value from the table further relating the index values to second parameter values, such that a new second parameter value corresponding to the new index value substantially matches the current second parameter value. Thus, the index value is optimized simultaneously for both the first and second parameters.

The index value determination block 13 may determine the new index value from the table such that substantially matching the current second parameter value has precedence.

The apparatus 100 may further include replacing means for replacing a current value of the index corresponding to the at least first parameter by the determined new index value, and output enhanced coded speech containing the new index value.

Referring to FIGS. 13 and 14, the first parameter value may be the background noise level parameter value which is determined and adjusted and for which a new index value is determined in order to adjust the background noise level.

Alternatively, the second parameter value may be the background noise level parameter the index value of which is determined in accordance with the adjusted speech level.

As discussed beforehand, the speech level manipulation requires also manipulating the background noise level parameter during speech pauses in DTX.

According to the AMR codec, the background noise level parameter, the averaged logarithmic frame energy, is quantized with 6 bits. The comfort noise level can be adjusted by changing the energy index value. The level can be adjusted in 1.5 dB, so finding a suitable comfort noise level corresponding to the change of the speech level is possible.

The evaluated comfort noise parameters (the average LSF (Line Spectral Frequency) parameter vector $f^{mean}$ and the averaged logarithmic frame energy $$en_{\log}^{mean})$$

are encoded into a special frame, called a Silence Descriptor (SID) frame for transmission to the receiver side. The parameters give information on the level $$(en_{\log}^{mean})$$

and the spectrum ($f^{mean}$) of the background noise. More details can be found in 3GPP TS 26.093 V4.0.0 (2001-03), "3rd Generation Partnership Project; Technical Specification Group Services and System Aspects; Mandatory Speech Codec speech processing functions; AMR speech codec; Source controlled rate operation (Release 6)".

The frame energy is computed for each frame marked with Voice Activity Detector VAD=0 according to the equation:

$$en_{log}(i) = \frac{1}{2}\log_2\left(\frac{1}{N}\sum_{n=0}^{N-1} x^2(n)\right),$$

where x is the HP-filtered input speech signal of the current frame i. The averaged logarithmic energy, which will be transmitted, is computed by:

$$en_{\log}^{mean}(i) = \frac{1}{8}\sum_{m=0}^{7} en_{\log}(i-m).$$

The averaged logarithmic energy is quantized by means of a 6 bit algorithmic quantizer. Quantization is performed using quantization function, as defined in 3GPP TS 26.104 V4.1.0 2001-06, "AMR Floating-point Speech Codec C-source".

$$\text{index} = \lfloor (en_{\log}^{mean}(i) + 2.5)\cdot 4 + 0.5 \rfloor,$$

where the value of the index is restricted to a range [0 . . . 63], i.e. in a range of 6 bits.

The index can be computed using base 10 logarithm as follows:

$$\text{index} = \lfloor (en_{\log}^{mean}(i) + 2.5)\cdot 4 + 0.5 \rfloor = \lfloor 4\cdot en_{\log}^{mean}(i) + 10.5 \rfloor$$

$$\text{index} = \left\lfloor 4\frac{1}{2}\frac{\log_{10} en^{mean}(i)}{\log_{10} 2} + 10.5 \right\rfloor = \left\lfloor 2\frac{1}{10}\frac{10\log_{10} en^{mean}(i)}{\log_{10} 2} + 10.5 \right\rfloor,$$

$$\text{index} \approx \left\lfloor \frac{1}{1.5} 10\log_{10} en^{mean}(i) + 10.5 \right\rfloor$$

where $10\log_{10} en^{mean}(i)$ is the energy in decibels. Therefore, it is shown that one quantization step corresponds to approximately 1.5 dB.

In the following the gain adjustment of the comfort noise parameters is described.

Since an energy parameter is transmitted, the signal energy can be manipulated directly by modifying the energy parameters. As shown above, one quantization step equals to 1.5 dB. Assuming that all eight frames of a SID update interval will be scaled by $\alpha$, the new index can be found as follows $$index^{new} = \left\lfloor \left(en_{\log}^{mean}(i) + \frac{1}{2}\log_2 \alpha^2 + 2.5\right)\cdot 4 + 0.5 \right\rfloor$$
$$= \lfloor 4\cdot en_{\log}^{mean}(i) + 10.5 + 4\log_2 \alpha \rfloor.$$

Because the old index was as $$\text{index} = \lfloor 4\cdot en_{\log}^{mean}(i) + 10.5 \rfloor,$$

the new index can be approximated by $$\text{index}^{new} \approx \lfloor 4\log_2 \alpha \rfloor + \text{index}.$$

Referring back to FIGS. 13 and 14, a parameter value to be adjusted may be the comfort noise parameter value. Accordingly, a new index value $index^{new}$ is determined as mentioned above. In other words, a current background noise parameter index value index may be detected, and a new background noise parameter index value $index^{new}$ may be determined by adding $\lfloor 4\log_2 \alpha \rfloor$ to the current background noise parameter index value index, wherein $\alpha$ corresponds to the enhancement of the first characteristic represented by the first speech parameter.

The level of the synthesized speech signal can be adjusted by manipulating the fixed codebook gain factor index, as shown previously. While being a measure of prediction error, the fixed codebook gain factor index does not discover the level of the speech signal. Therefore, to control the gain manipulation, i.e. to determine whether the level should be changed, the speech signal level must be first estimated.

In TFO, the six or seven MSB of the PCM speech samples (not compressed) are transmitted to the far end unchanged, to facilitate a seamless TFO interruption. These six or seven MSB can be used to estimate the speech level.

If these PCM speech samples are unavailable, the coded speech signal must be at least partially decoded (post-filtering is not necessary) to estimate the speech level.

Alternatively, there is the possibility of using a fixed gain, thereby avoiding a complete decoding. FIG. 15 shows a block diagram illustrating a scheme with the possibility of using a constant gain in the gain manipulation described above. In this case, decoding PCM signals out of the codec signal for using the PCM signals in the gain estimation (i.e. speech level estimation) is not required. The speech may be coded with e.g. AMR, AMR-WB (AMR WideBand), GSM FR, GSM EFR, GSM HR speech codecs.

FIG. 16 shows a high level implementation example of the present invention in an MGW (Media GateWay) of the 3G network architecture. For example, the present invention may be implemented in a DSP (Digital Signal Processor) of the MGW. However, it is to be noted that the implementation of the invention is not limited to an MGW.

As shown in FIG. 16, coded speech is fed to the MGW. The coded speech comprises at least one index corresponding to a value of a speech parameter which adjusts the level of synthesized speech. This index may also indicate a value of another speech parameter which is affected by the speech parameter for adjusting the level of synthesized speech. For example, this other speech parameter adjusts the periodicity or pitch of the synthesized speech.

In a VED (Voice Enhancement Device) shown in FIG. 16, the index is controlled so as to adjust the level of the speech to a desired level. A new index indicating values of the speech parameters affecting the level of the speech, such as the fixed codebook gain factor and adaptive codebook gain, is determined by minimizing an error between the desired level and the realized effective level. As a result, the new index is found which indicates values of the speech parameters realizing the desired level of speech. The original index is replaced by the new index and enhanced coded speech is output.

It is to be noted that the partial decoding of speech shown in FIG. 16 relates to controlling means for determining a current level of speech to decide whether the level should be adjusted.

The above described embodiments of the present invention may not only be utilized in level control itself, but also in noise suppression and echo control (nonlinear processing) in the coded domain. Noise suppression can utilize the above technique by e.g. adjusting the comfort noise level during speech pauses. Echo control may utilize the above technique e.g. by attenuating the speech signal during echo bursts.

The present invention is not intended to be limited only to TFO and TrFO voice communication and to voice communication over packet-switched networks, but rather to comprise enhancing coded audio signals in general. The invention finds application also in enhancing coded audio signals related e.g. to audio/speech/multimedia streaming applications and to MMS (Multimedia Messaging Service) applications.

It is to be understood that the above description is illustrative of the invention and is not to be construed as limiting the invention. Various modifications and applications may occur to those skilled in the art without departing from the scope of the invention as defined by the appended claims.

The invention claimed is:

1. A method, comprising:

determining, at an apparatus, an old fixed codebook gain correction factor $\hat{\gamma}_{gc}^{old}$ from an index corresponding to a fixed codebook gain, wherein a coded audio signal comprises indices that represent audio signal parameters comprising at least the fixed codebook gain representing a first characteristic of the audio signal and an adaptive codebook gain;

adjusting the old fixed codebook gain correction factor $\hat{\gamma}_{gc}^{old}$ in order to achieve an enhanced first characteristic, thereby obtaining desired gain $\beta\cdot\hat{\gamma}_{gc}^{old}$;

determining an old adaptive codebook gain value $g_{p_old}$ from the index further corresponding to the adaptive codebook gain; and determining a new index value from a table relating index values to fixed codebook gain correction factors and relating the index values to adaptive codebook gain values by minimizing an error $|\beta\cdot\hat{\gamma}_{gc}^{old}-\hat{\gamma}_{gc}^{new}|$ between the desired gain and a new fixed codebook gain correction factor $\hat{\gamma}_{gc}^{new}$ corresponding to the new index value such that no audible error is introduced to a new adaptive codebook gain value $g_{p_new}$ new corresponding to the new index value.

2. The method according to claim 1, further comprising:

replacing a current value of the index corresponding to at least the fixed codebook gain by the determined new index value.

3. The method according to claim 1, further comprising:

detecting a current background noise parameter index value; and determining a new background noise parameter index value corresponding to the first enhanced characteristic.

4. The method according to claim 1, further comprising:

determining the new index value from the table such that a substantial match of the old adaptive codebook gain value has precedence.

5. An apparatus, comprising:

a parameter value determiner configured to determine an old fixed codebook gain correction factor $\hat{\gamma}_{gc}^{old}$ from an index corresponding to a fixed codebook gain and determine an old adaptive codebook gain value $g_{p_old}$ from the index further corresponding to an adaptive codebook gain, wherein a coded audio signal comprises indices that represent audio signal parameters comprising at least the fixed codebook gain representing a first characteristic of the audio signal and the adaptive codebook gain;

an adjuster configured to adjust the old fixed codebook gain correction factor in order to achieve an enhanced first characteristic, thereby obtaining a desired gain $\beta\cdot\hat{\gamma}_{gc}^{old}$; and an index value determiner configured to determine a new index value from a table relating index values to fixed codebook gain correction factors and relating the index values to adaptive codebook gain values by minimizing an error $|\beta\cdot\hat{\gamma}_{gc}^{old}-\hat{\gamma}_{gc}^{new}|$ between the desired gain and a new fixed codebook gain correction factor $\hat{\gamma}_{gc}^{new}$ corresponding to the new index value such that no audible error is introduced to a new adaptive codebook gain value $g_{p_new}$ corresponding to the new index value.

6. The apparatus according to claim 5, further comprising:

a replacer configured to replace a current value of the index corresponding to at least the fixed codebook gain by the determined new index value.

7. The apparatus according to claim 5, further comprising:

a detector configured to detect a current background noise parameter index value; and a determiner configured to determine a new background noise parameter index value corresponding to the enhanced first characteristic.

8. The apparatus according to claim 5, wherein the index value determiner is configured to determine the new index value from the table such that substantially matching the old adaptive codebook gain value has precedence.

9. A method, comprising:

determining, at an apparatus, an old fixed codebook gain correction factor $\hat{\gamma}_{gc}^{old}$ from an index corresponding to a fixed codebook gain, wherein a coded audio signal comprises indices that represent audio signal parameters comprising at least the fixed codebook gain representing a first characteristic of the audio signal, an adaptive codebook gain and a background noise parameter;

adjusting the old fixed codebook gain correction factor in order to achieve an enhanced first characteristic, thereby obtaining a desired gain $\beta\cdot\hat{\gamma}_{gc}^{old}$;

determining an old adaptive codebook gain value $g_{p_old}$ from the index further corresponding to the adaptive codebook gain;

determining a new index value from a table relating index values to fixed codebook gain correction factors and relating the index values to adaptive codebook gain values by minimizing an error $|\beta\cdot\hat{\gamma}_{gc}^{old}-\hat{\gamma}_{gc}^{new}|$ between the desired gain and a new fixed codebook gain correction factor $\hat{\gamma}_{gc}^{new}$ corresponding to the new index value such that no audible error is introduced to a new adaptive codebook gain value $g_{p_new}$ corresponding to the new index value;

detecting a current background noise parameter index value; and determining a new background noise parameter index value corresponding to the enhanced first characteristic.

10. An apparatus, comprising:

parameter value determination means for determining an old fixed codebook gain correction factor $\hat{\gamma}_{gc}^{old}$ from an index corresponding to a fixed codebook gain and for determining an old adaptive codebook gain value $g_{p_old}$ from the index further corresponding to an adaptive codebook gain, wherein a coded audio signal comprises indices that represent audio signal parameters comprising at least the fixed codebook gain representing a first characteristic of the audio signal, the adaptive codebook gain and a background noise parameter;

adjusting means for adjusting the old fixed codebook gain correction factor in order to achieve an enhanced first characteristic, thereby obtaining a desired gain $\beta\cdot\hat{\gamma}_{gc}^{old}$;

index value determination means for determining a new index value from a table relating index values to fixed codebook gain correction factors and relating the index values to adaptive codebook gain values by minimizing an error $|\beta\cdot\hat{\gamma}_{gc}^{old}-\hat{\gamma}_{gc}^{new}|$ flew between the desired gain and a new fixed codebook gain correction factor $\hat{\gamma}_{gc}^{new}$ corresponding to the new index value such that no audible error is introduced to a new adaptive codebook gain value $g_{p_new}$ corresponding to the new index value;

detecting means for detecting a current background noise parameter index value; and determining means for determining a new background noise parameter index value corresponding to the enhanced first characteristic.

11. A computer program embodied on a computer-readable medium comprising a program code configured to control a processor to execute a process of enhancing a coded audio signal comprising indices which represent audio signal parameters which comprise at least a fixed codebook gain representing a first characteristic of the audio signal and an adaptive codebook gain, the process comprising:

determining an old fixed codebook gain correction factor $\hat{\gamma}_{gc}^{old}$ from an index corresponding to a fixed codebook gain;

adjusting the old fixed codebook gain correction factor in order to achieve an enhanced first characteristic, thereby obtaining a desired gain $\beta\cdot\hat{\gamma}_{gc}^{old}$;

determining an old adaptive codebook gain value $g_{p_old}$ from the index further corresponding to an adaptive codebook gain; and determining a new index value from a table relating index values to fixed codebook gain correction factors and relating the index values to adaptive codebook gain values, by minimizing an error $|\beta\cdot\hat{\gamma}_{gc}^{old}-\hat{\gamma}_{gc}^{new}|$ between the desired gain and a new fixed codebook gain correction factor $\hat{\gamma}_{gc}^{new}$ corresponding to the new index value such that no audible error is introduced to a new adaptive codebook gain value $g_{p_new}$ corresponding to the new index value.

12. The computer program according to claim 11, wherein said computer program is directly loadable into an internal memory of the computer.

13. A computer program embodied on a computer-readable medium comprising a program code configured to control a processor to execute a process of enhancing a coded audio signal comprising indices which represent audio signal parameters which comprise at least a fixed codebook gain representing a first characteristic of the audio signal, an adaptive codebook gain and a background noise parameter, the process comprising:

determining an old fixed codebook gain correction factor $\hat{\gamma}_{gc}^{old}$ from an index corresponding to a fixed codebook gain;

adjusting the old fixed codebook gain correction factor in order to achieve an enhanced first characteristic, thereby obtaining a desired gain $\beta\cdot\hat{\gamma}_{gc}^{old}$;

determining an old adaptive codebook gain value $g_{p_old}$ from the index further corresponding to an adaptive codebook gain;

determining a new index value from a table relating index values to fixed codebook gain correction factors and relating the index values to adaptive codebook gain values by minimizing an error $|\beta\cdot\hat{\gamma}_{gc}^{old}-\hat{\gamma}_{gc}^{new}|$ between the desired gain and a new fixed codebook gain correction factor $\hat{\gamma}_{gc}^{new}$ corresponding to the new index value such that no audible error is introduced to a new adaptive codebook gain value $g_{p_new}$ corresponding to the new index value;

detecting a current background noise parameter index value; and determining a new background noise parameter index value corresponding to the enhanced first characteristic.

14. An apparatus, comprising:

parameter value determination means for determining an old fixed codebook gain correction factor $g_{p_old}$ from an index corresponding to a fixed codebook gain and determining an old adaptive codebook gain value $g_{p_old}$ from the index further corresponding to an adaptive codebook gain, wherein a coded audio signal comprises indices that represent audio signal parameters comprising at least the fixed codebook gain representing a first characteristic of the audio signal and the adaptive codebook gain;

adjusting means for adjusting the old fixed codebook gain correction factor in order to achieve an enhanced first characteristic, thereby obtaining a desired gain $\beta\cdot\hat{\gamma}_{gc}^{old}$; and index value determination means for determining a new index value from a table relating index values to fixed codebook gain correction values and relating the index values to adaptive codebook gain values by minimizing an error $|\beta\cdot\hat{\gamma}_{gc}^{old}-\hat{\gamma}_{gc}^{new}|$ between the desired gain and a new fixed codebook gain correction factor $\hat{\gamma}_{gc}^{new}$ corresponding to the new index value such that no audible error is introduced to a new adaptive codebook gain value $g_{p_new}$ corresponding to the new index value.

15. An apparatus, comprising:

a parameter value determiner configured to determine an old fixed codebook gain correction factor $\hat{\gamma}_{gc}^{old}$ from an index corresponding to a fixed codebook gain and determine an old adaptive codebook gain value $g_{p_old}$ from the index further corresponding to an adaptive codebook gain, wherein a coded audio signal comprises indices that represent audio signal parameters comprising at least the fixed codebook gain representing a first characteristic of the audio signal, the adaptive codebook gain and a background noise parameter;

an adjuster configured to adjust the old fixed codebook gain correction factor in order to achieve an enhanced first characteristic, thereby obtaining a desired gain $\beta\cdot\hat{\gamma}_{gc}^{old}$;

an index value determiner configured to determine a new index value from a table relating index values to fixed codebook gain correction factors and relating the index values to adaptive codebook gain values by minimizing an error $|\beta\cdot\hat{\gamma}_{gc}^{old}-\hat{\gamma}_{gc}^{new}|$ between the desired gain and a new fixed codebook gain correction factor $\hat{\gamma}_{gc}^{new}$ corresponding to the new index value such that no audible error is introduced to a new adaptive codebook gain value $g_{p_new}$ corresponding to the new index value;

a detector configured to detect a current background noise parameter index value; and a determiner configured to determine a new background noise parameter index value corresponding to the enhanced first characteristic.

* * * * *